US009955750B2

(12) United States Patent
Montross et al.

(10) Patent No.: US 9,955,750 B2
(45) Date of Patent: May 1, 2018

(54) ARTICLE OF FOOTWEAR WITH SOLE PROJECTIONS

(75) Inventors: Matthew Montross, Middleboro, MA (US); Ricardo Vestuti, Providence, RI (US)

(73) Assignee: Reebok International Limited, London (GB)

( * ) Notice: Subject to any disclaimer, the term of this patent is extended or adjusted under 35 U.S.C. 154(b) by 0 days. days.

(21) Appl. No.: 13/545,603

(22) Filed: Jul. 10, 2012

(65) Prior Publication Data

US 2014/0013617 A1 Jan. 16, 2014

(51) Int. Cl.

| | |
|---|---|
| ***A43C 15/00*** | (2006.01) |
| ***A43B 7/32*** | (2006.01) |
| ***A43B 13/18*** | (2006.01) |
| ***A43B 13/22*** | (2006.01) |

(52) U.S. Cl.

CPC ..... *A43B 7/32* (2013.01); *A43B 13/184* (2013.01); *A43B 13/186* (2013.01); *A43B 13/223* (2013.01)

(58) Field of Classification Search

CPC ..... A43B 5/00; A43B 5/06; A43B 13/184; A43B 13/223; A43B 13/26

USPC ..... 36/59 R, 59 C, 59 A, 67 R, 67 A, 67 D, 36/103, 28, 114, 8.1; D2/954, 955, 956, D2/957, 962, 958, 959

See application file for complete search history.

(56) References Cited

U.S. PATENT DOCUMENTS

| | | | | |
|---|---|---|---|---|
| 500,385 A | | 6/1893 | Hall | |
| 2,068,238 A | | 1/1937 | Malm | |
| 2,155,166 A | | 4/1939 | Kraft | |
| 2,188,168 A | | 1/1940 | Winkel | |
| 2,224,590 A | | 12/1940 | Boivin | |
| 2,860,425 A | | 11/1958 | Jackson | |
| 3,148,378 A | | 9/1964 | Tibbitts | |
| 3,328,901 A | * | 7/1967 | Strickland | 36/59 R |
| 3,634,954 A | | 1/1972 | Larsen et al. | |
| 3,648,109 A | | 3/1972 | Tims et al. | |
| 3,676,940 A | * | 7/1972 | Shively | 36/8.1 |
| 3,724,107 A | | 4/1973 | Makinen et al. | |

(Continued)

FOREIGN PATENT DOCUMENTS

| | | |
|---|---|---|
| CH | 216930 A | 9/1941 |
| DE | 201097 C1 | 11/1907 |

(Continued)

OTHER PUBLICATIONS

"KICKSstyle" in The International Street Magazine, pp. 54-55, Aug. 20, 2001 (with translation of p. 55).

(Continued)

*Primary Examiner* — Katharine Gracz

(74) *Attorney, Agent, or Firm* — Sterne, Kessler, Goldstein & Fox P.L.L.C.

(57) ABSTRACT

An article of footwear includes a sole having a main sole body and a plurality of projections extending from the main sole body. The plurality of projections includes a central row of projections extending generally along the longitudinal axis of the sole, a lateral row of projections on the lateral side of the sole, and a medial row of projections on the medial side of the sole. In one aspect, at least one of the projections in the central row of projections extends further from the main sole body in a vertical direction than adjacent projections in the lateral row of projections and the medial row of projections.

22 Claims, 28 Drawing Sheets

(56) References Cited

U.S. PATENT DOCUMENTS 3,762,075 A 10/1973 Munschy
D236,563 S 9/1975 Wunsch
4,043,326 A 8/1977 Little et al.
4,067,123 A * 1/1978 Minihane ..... 36/32 R
4,085,526 A * 4/1978 Hemmer ..... 36/59 R
4,085,527 A * 4/1978 Riggs ..... 36/114
4,118,878 A 10/1978 Semon
4,130,947 A * 12/1978 Denu ..... 36/30 R
4,265,032 A 5/1981 Levine
4,309,831 A 1/1982 Pritt
4,309,832 A 1/1982 Hunt
4,378,643 A * 4/1983 Johnson ..... A43B 13/223 36/129
4,393,604 A 7/1983 Crowley
4,402,145 A * 9/1983 Dassler ..... 36/32 R
4,443,511 A 4/1984 Worden et al.
4,498,251 A 2/1985 Shin
4,516,336 A 5/1985 Nissenbaum
4,527,345 A * 7/1985 Lopez Lopez ..... 36/127
D281,642 S 12/1985 Fuzita
4,631,755 A 12/1986 Zingg et al.
D288,027 S 2/1987 Tonkel
4,642,917 A * 2/1987 Ungar ..... 36/59 C
4,843,741 A 6/1989 Yung
RE33,018 E 8/1989 Ostrander
4,885,851 A * 12/1989 Peterson ..... 36/127
4,905,382 A 3/1990 Yung
4,908,962 A 3/1990 Yung
4,908,964 A 3/1990 Deem
4,944,099 A 7/1990 Davis
5,127,170 A 7/1992 Messina
5,265,349 A 11/1993 Munschy
5,400,526 A 3/1995 Sessa
5,461,801 A * 10/1995 Anderton ..... 36/114
5,548,910 A 8/1996 Klingseis
5,551,173 A 9/1996 Chambers
5,584,077 A 12/1996 Thrift
D378,472 S 3/1997 Bramani
D380,889 S 7/1997 Earle
D385,392 S 10/1997 Cass
D394,944 S 6/1998 Doxey
5,832,539 A 11/1998 Williams
5,896,680 A * 4/1999 Kim et al. ..... 36/28
5,901,467 A 5/1999 Peterson et al.
5,918,385 A * 7/1999 Sessa ..... 36/59 C
5,943,794 A * 8/1999 Gelsomini ..... 36/127
5,956,868 A 9/1999 Stevens et al.
D416,669 S 11/1999 Parr et al.
5,987,783 A * 11/1999 Allen et al. ..... 36/127
5,992,053 A * 11/1999 Hansen ..... 36/7.5
D421,832 S 3/2000 Loveder
6,052,921 A 4/2000 Oreck
6,061,929 A 5/2000 Ritter
D429,062 S 8/2000 Santa
6,115,945 A 9/2000 Ellis, III
6,128,835 A 10/2000 Ritter et al.
D440,031 S 4/2001 White
D440,032 S * 4/2001 Madden ..... D2/954
D449,729 S 10/2001 von Conta
6,298,583 B1 10/2001 Allen
D452,061 S 12/2001 Smith
6,367,166 B1 4/2002 Barthelemy et al.
D470,999 S 3/2003 Schroeder et al.
D474,586 S 5/2003 Recchi
D475,514 S 6/2003 Burg et al.
6,584,704 B2 7/2003 March
6,634,121 B2 10/2003 Sordi
6,684,532 B2 2/2004 Greene et al.
D492,095 S 6/2004 Sanchez et al.
D496,779 S 10/2004 Belley et al.
D502,308 S 3/2005 Teague
6,860,037 B1 3/2005 Norek
6,948,264 B1 * 9/2005 Lyden ..... 36/59 C
6,990,755 B2 1/2006 Hatfield et al.
D521,715 S 5/2006 Lotti
D530,493 S 10/2006 Holmes
7,140,129 B2 * 11/2006 Newson et al. ..... 36/100
7,168,190 B1 1/2007 Gillespie
D538,519 S 3/2007 McCiaskie
D543,340 S 5/2007 Favreau et al.
D548,437 S * 8/2007 McClaskie ..... D2/956
D552,837 S 10/2007 Scott
7,290,357 B2 11/2007 McDonald et al.
D560,336 S 1/2008 Nakashima et al.
D561,438 S 2/2008 Belley
D561,440 S 2/2008 Andersen et al.
D572,447 S * 7/2008 Schoenborn et al. ..... D2/956
7,392,605 B2 7/2008 Hatfield et al.
D581,641 S 12/2008 Bethke, Jr.
D584,491 S 1/2009 Matis
D584,492 S 1/2009 Lee
D586,991 S 2/2009 Fuerst
D586,992 S 2/2009 Duffy
7,607,241 B2 10/2009 McDonald et al.
7,637,035 B1 12/2009 Gillespie
7,650,707 B2 1/2010 Campbell et al.
D609,896 S 2/2010 Christie
7,762,008 B1 7/2010 Clark et al.
7,784,196 B1 * 8/2010 Christensen et al. ..... 36/29
7,788,827 B2 * 9/2010 Fogg et al. ..... 36/59 C
7,793,432 B2 9/2010 Chan et al.
D626,320 S 11/2010 Anderson
D630,420 S 1/2011 Truelsen
D632,879 S 2/2011 Merkazy et al.
7,941,938 B2 5/2011 Yu et al.
7,946,058 B2 5/2011 Johnson et al.
D642,362 S 8/2011 Miner
D643,195 S 8/2011 Yi
8,020,320 B2 9/2011 Gillespie
D650,975 S 12/2011 Menghi
8,104,197 B2 1/2012 Flannery et al.
D653,437 S 2/2012 Mongelli
D654,259 S 2/2012 Hatfield
D655,901 S 3/2012 Raysse
D656,304 S 3/2012 Debiase
8,286,371 B2 * 10/2012 Baker et al. ..... 36/67 A
2003/0093920 A1 5/2003 Greene et al.
2004/0040181 A1 * 3/2004 Kim ..... 36/127
2004/0123495 A1 7/2004 Greene et al.
2005/0262739 A1 12/2005 McDonald et al.
2006/0130368 A1 * 6/2006 Morgan ..... 36/59 R
2006/0201028 A1 9/2006 Chan et al.
2006/0225305 A1 * 10/2006 Morgan et al. ..... 36/59 R
2008/0010854 A1 * 1/2008 Sokolowski ..... A43B 5/12 36/8.3
2008/0010860 A1 * 1/2008 Gyr ..... 36/89
2008/0022553 A1 1/2008 McDonald et al.
2008/0060228 A1 3/2008 Morgan et al.
2008/0229617 A1 9/2008 Johnson et al.
2008/0244926 A1 10/2008 Yu et al.
2009/0013559 A1 1/2009 Chan et al.
2009/0100718 A1 * 4/2009 Gerber ..... 36/128
2009/0113760 A1 * 5/2009 Dominguez ..... 36/102
2010/0126043 A1 5/2010 Loverin et al.
2010/0180474 A1 7/2010 Clark et al.
2010/0251565 A1 * 10/2010 Litchfield ..... A43B 13/12 36/28
2010/0293816 A1 * 11/2010 Truelsen ..... 36/30 R
2011/0016749 A1 1/2011 Callahan et al.
2011/0061265 A1 3/2011 Lyden
2011/0078922 A1 4/2011 Cavaliere et al.
2011/0113646 A1 5/2011 Merritt et al.
2011/0154688 A1 6/2011 Yu et al.
2011/0185590 A1 8/2011 Nishiwaki et al.
2011/0214313 A1 9/2011 James et al.
2011/0247243 A1 * 10/2011 Eder et al. ..... 36/67 A
2011/0289799 A1 12/2011 Keating et al.
2012/0073160 A1 * 3/2012 Marvin ..... A43B 13/186 36/28

FOREIGN PATENT DOCUMENTS

DE 1636455 U 3/1952
DE 862102 C1 1/1953

(56) References Cited

FOREIGN PATENT DOCUMENTS

| | | | |
|---|---|---|---|
| DE | 940756 | C1 | 3/1956 |
| DE | 1914002 | U | 4/1965 |
| DE | 6924927 | U | 6/1969 |
| DE | 1485821 | A | 1/1970 |
| DE | 3630738 | A | 3/1988 |
| DE | 8907333 | U | 12/1989 |
| DE | 9303653 | U | 6/1993 |
| FR | 1281619 | A | 12/1961 |
| FR | 25787525 | A3 | 10/1986 |
| GB | 28488 | A | 12/1912 |
| JP | S59-072901 | U | 5/1984 |
| JP | H02-023129 | Y | 6/1990 |
| JP | H03-012249 | Y | 3/1991 |
| JP | H04-297201 | A | 10/1992 |
| JP | 3011970 | U | 3/1995 |
| JP | H07-236503 | A | 9/1995 |
| JP | H08-131201 | A | 5/1996 |
| JP | 3045628 | U | 11/1997 |
| JP | H10-179204 | A | 7/1998 |
| JP | 2000-106902 | A | 4/2000 |
| JP | 2000-201704 | A | 7/2000 |
| JP | 2001-057901 | A | 3/2001 |
| JP | 2001-061509 | A | 3/2001 |
| JP | 2003-516781 | A | 5/2003 |
| NL | 273820 | A | 9/1964 |
| NL | 9400255 | A | 10/1995 |

OTHER PUBLICATIONS

U.S. Appl. No. 13/339,583, Christensen et al., "Sole and Article of Footwear Having Pod Assembly", filed Dec. 29, 2011.

U.S. Appl. No. 13/339,592, Christensen et al., "Sole and Article of Footwear Having Pod Assembly", filed Dec. 29, 2011.

U.S. Appl. No. 29/378,310, Marvin et al., "Portion of a Shoe", filed Nov. 2, 2010.

U.S. Appl. No. 29/416,618, Christensen et al., "Portion of a Shoe", filed Mar. 23, 2012.

U.S. Appl. No. 12/890,266, Marvin et al., "Sole with Projections and Article of Footwear", filed Sep. 24, 2010.

* cited by examiner

ARTICLE OF FOOTWEAR WITH SOLE PROJECTIONS

BACKGROUND OF THE INVENTION

Field of the Invention

Embodiments of the present invention generally relate to footwear, and more particularly relate to an article of footwear having projections extending from a sole of the article of footwear.

Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to cushion to the wearer's foot and to protect it from these forces. To achieve adequate cushioning, many footwear soles are relatively thick and heavy. When sole size and/or weight are reduced to achieve other performance goals, protection of the wearer's foot is often compromised.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

In addition, while wearing footwear with appropriate cushioning and support can help to minimize injuries, individuals can further limit injuries and improve their overall physical conditioning by participating in a regular exercise program. There are many activities in daily life that require individuals to use their strength, agility, and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Exercise also strengthens muscles, increases flexibility, and promotes stronger bones, which can help prevent osteoporosis.

In today's society, many individuals struggle to maintain basic levels of fitness. Time is one of the main roadblocks to maintaining a consistent training program, both for the elite athlete and the individual struggling to maintain physical fitness. There is an ever-increasing amount of demand on a person's free time.

In response to these concerns, over the years companies have developed various forms of exercise equipment and training programs designed to maximize the efficiency of an individual's training. The equipment and programs often achieve the desired result—reducing the amount of time investment necessary to maintain physical fitness. However, these methods still require an individual to allocate a block of time out of the individual's schedule for a workout.

Thus, there is a need for a training aid that allows a user to incorporate a workout into his or her daily routine while minimizing the time investment required.

BRIEF SUMMARY OF THE INVENTION

In one embodiment, an article of footwear includes a sole having a main sole body and a plurality of projections extending from the main sole body. The sole has a medial side, a lateral side, and a longitudinal axis. The plurality of projections include a central row of projections extending generally along the longitudinal axis of the sole, a lateral row of projections on the lateral side of the sole, and a medial row of projections on the medial side of the sole. At least one of the projections in the central row of projections extends further from the main sole body in a vertical direction than adjacent projections in the lateral row of projections and the medial row of projections. The central row of projections can include a rear heel projection extending at an angle from the rear of the main sole body. Outsole material can be provided on one or more of the projections.

The sole can include a bridge element connecting two of the projections together to provide additional stability to the article of footwear. Projections in the lateral row of projections can extend from the main sole body at an angle. Projections in the medial row of projections can extend from the main sole body at an angle. The sole can include a forefoot portion, a midfoot portion, and a heel portion, and in the heel portion of the sole, at least some of the projections in the central row of projections can extend further from the main sole body in a vertical direction than adjacent projections in the lateral row of projections and the medial row of projections. In the forefoot portion of the sole, at least some of the projections in the central row of projections do not extend further from the main sole body in a vertical direction than adjacent projections in the lateral row of projections and the medial row of projections. The sole further includes a forefoot portion, a midfoot portion, and a heel portion. In the heel portion of the sole and in the forefoot portion of the sole, at least some of the projections in the central row of projections can extend further from the main sole body in a vertical direction than adjacent projections in the lateral row of projections and the medial row of projections.

In another aspect of the present invention, an article of footwear includes a sole having a main sole body and a plurality of projections extending from the main sole body. The sole has a medial side, a lateral side, and a longitudinal axis. The sole includes a forefoot portion, a midfoot portion, and a heel portion. The plurality of projections includes a central row of projections extending generally along the longitudinal axis of the sole, a lateral row of projections on the lateral side of the sole, and a medial row of projections on the medial side of the sole. In the heel portion of the sole, at least one of the projections in the lateral row of projections extends further from the main sole body in a vertical direction than at least one projection in the medial row of projections. The central row of projections can include a rear heel projection extending at an angle from the rear of the main sole body. Outsole material can be provided on one or more of the projections. The sole further includes a bridge element connecting two of the projections together to provide additional stability to the article of footwear. Projections in the lateral row of projections can extend from the main sole body at an angle. Projections in the medial row of projections can extend from the main sole body at an angle.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying figures. While specific configurations and arrangements are discussed, it should be understood that this is done for illustrative purposes only. References to "an embodiment", "one embodiment", "another embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, a person skilled in the relevant art will recognize that other configurations and arrangements can be used without departing from the spirit and scope of the invention.

Figure 1:
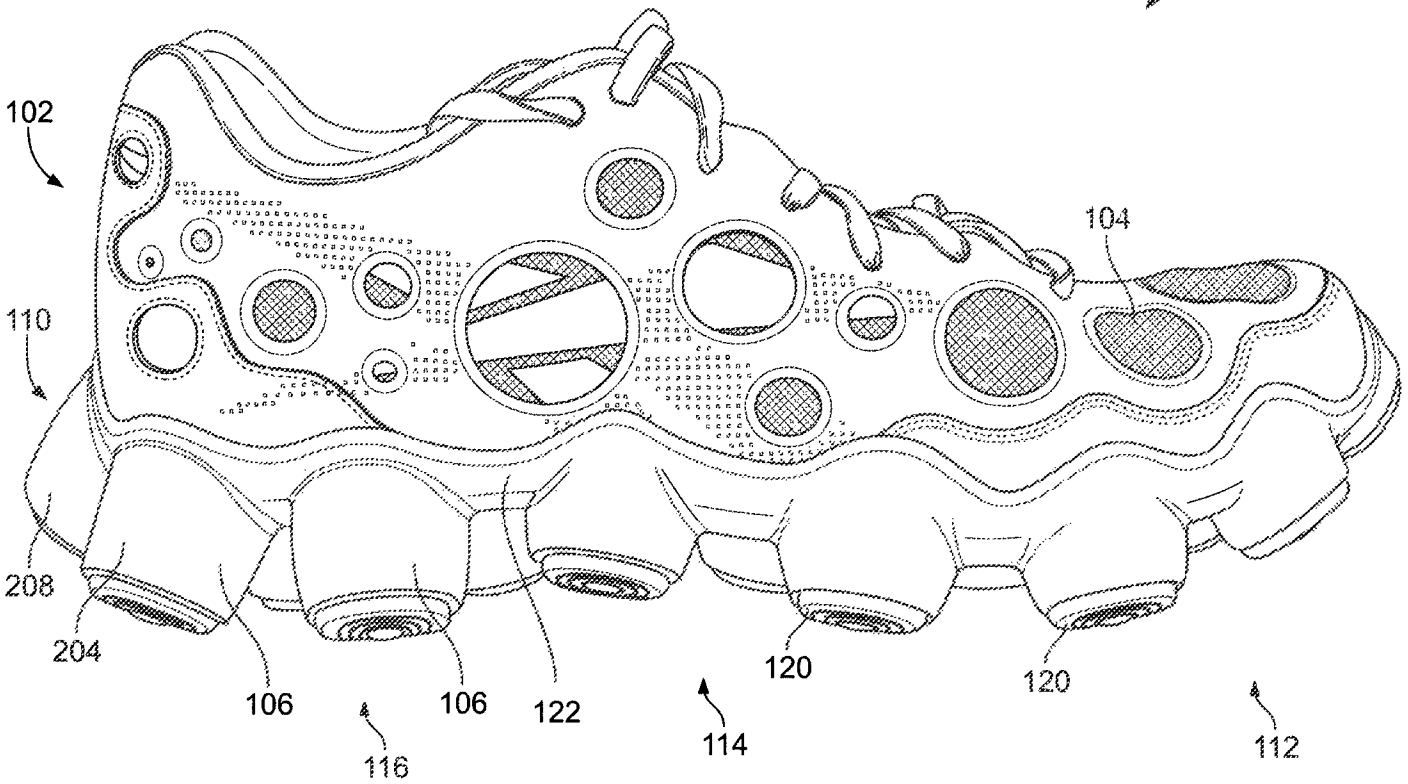
FIG. 1 is a lateral side view of an exemplary article of footwear according to an embodiment of the present invention.

Referring to the drawings and in particular to FIG. 1, an exemplary embodiment of an article of footwear, in particular a shoe, according to the present invention generally referred to by reference numeral 100 is shown. Although the article of footwear 100 may be referred to herein as shoe 100, it is contemplated that it may comprise any type of footwear in which the sole of the present invention may be desirable, including, but not limited to, walking shoes, running shoes, basketball shoes, court shoes, tennis shoes, training shoes, boots, and sandals.

FIG. 1 is a lateral view of a right shoe. However, to the extent that only the left or right article of footwear 100 is described for a particular embodiment of the present invention, it will be apparent to one of ordinary skill in the art that the article of footwear 100 suitable for the other foot, even if not specifically described, may comprise a mirror image of the described article of footwear 100.

The shoe 100 has a forefoot portion 112, a midfoot portion 114, and a heel portion 116. The shoe includes an upper 102 and a sole 110. The upper 102 may be formed to generally accommodate a human foot, and may comprise one or more textiles made of natural or man-made fibers. Materials appropriate for the upper 102 including, but not limited to, leather, rubber, and plastic, are considered to be within the scope of the present invention.

Sole 110 can also include outsole material 120 as a ground contacting material. In one embodiment of the present invention, an insole and/or sockliner may also be included within the shoe 100. In some embodiments, the sole 110 may include an insole and/or sockliner. The outsole material 120 may comprise a wear-resistant material. For example, outsole material 120 can include synthetic or natural rubber, thermoplastic polyurethane (TPU), a wear-resistant foam, or a combination thereof. The sole 110 may comprise a foam such as, for example, ethylene vinyl acetate (EVA) or polyurethane. The foam may be an open-cell foam or a closed-cell foam. In other embodiments, sole 110 may be formed of elastomers, thermoplastic elastomers (TPE), foam-like plastic (e.g., Pebax® foam or Hytrel® foam), and gel-like plastics. In some embodiments, the sole may include a molded thermoplastic component such as, for example, an injection molded TPU component. In one specific embodiment, the sole is substantially composed of a molded thermoplastic such as, for example, an injection molded TPU. Alternatively, the materials comprising the sole 110 and the outsole material 120 may be chosen as deemed fit by one of skill in the art. The sole 110 may be constructed out of one or more materials, and may have zones of differing densities.

Figure 8:
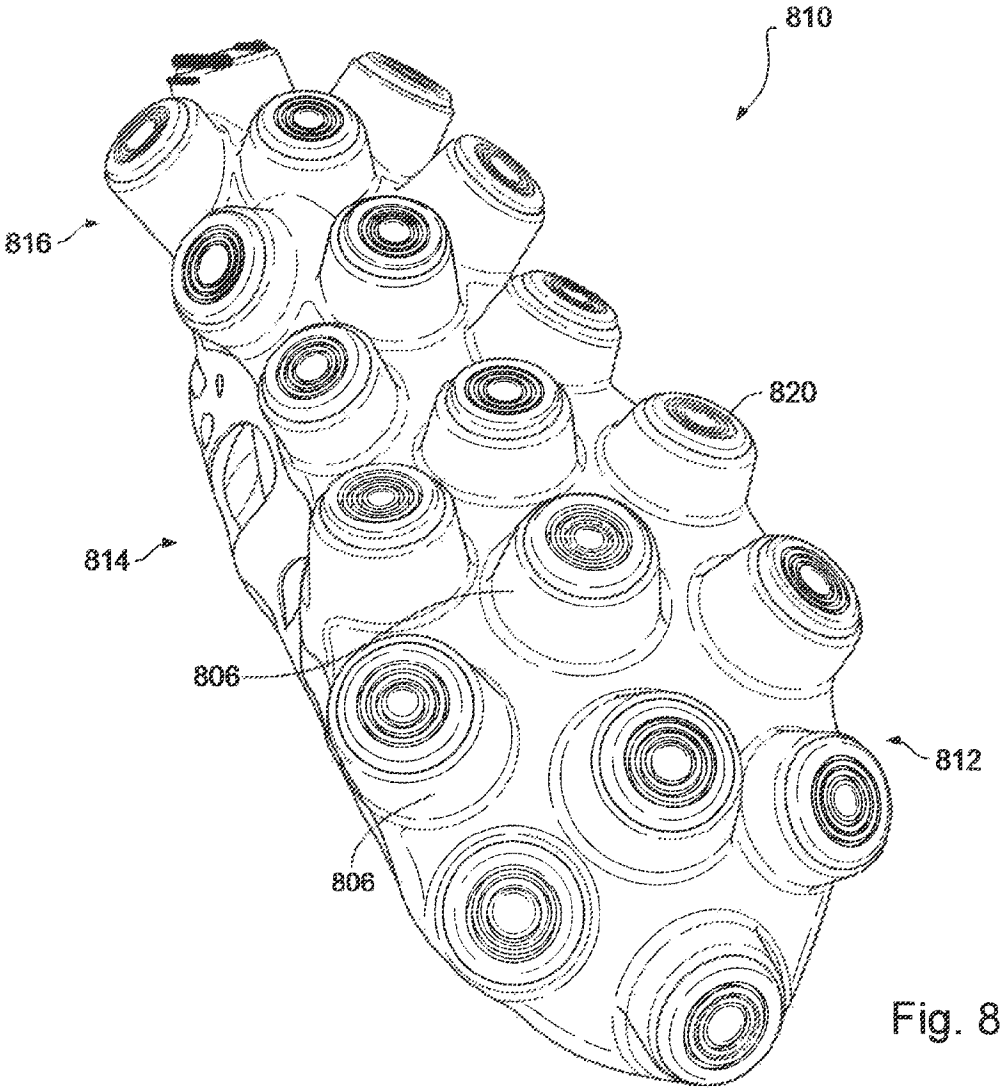
FIG. 8 is a bottom perspective view of another exemplary article of footwear according to an embodiment of the present invention.
Figure 9:
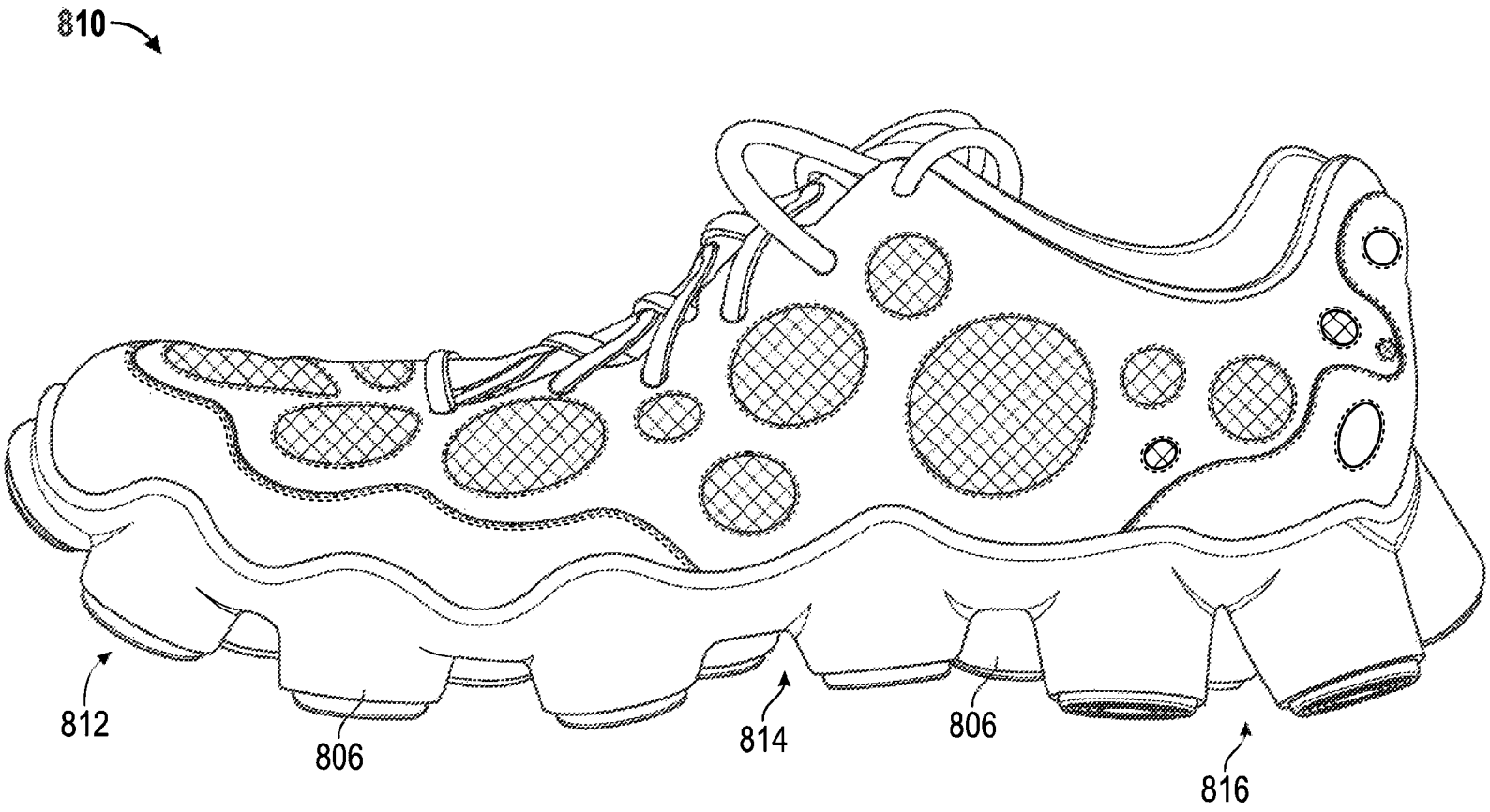
FIG. 9 is a medial side view of the exemplary article of footwear of FIG. 8 according to an embodiment of the present invention.
Figure 23:
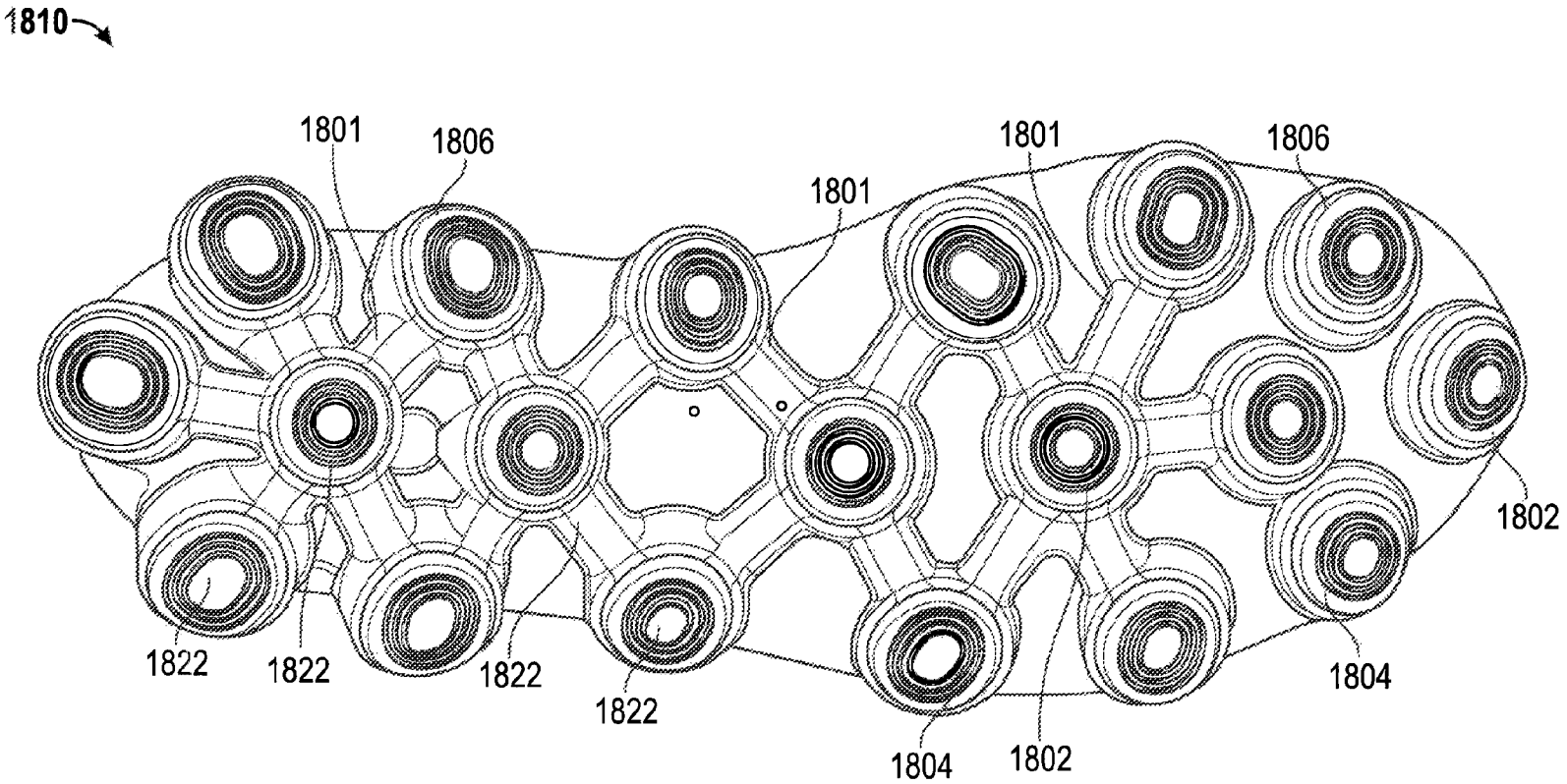
FIG. 23 is a bottom view of an exemplary sole according to an embodiment of the present invention.

The sole 110 of shoe 100 includes projections 106 extending downwardly from the main body 122 of the sole 110. Projections 106 can be formed in a variety of shapes, sizes, and densities in order to provide cushioning and weight properties that are tailored to specific areas of the sole 110. In one embodiment, one or more projections 106 may be cylindrical. Other shapes, including, but not limited to, rectangular, oval, semi-spherical, conical, frustoconical, rhomboidal, and other suitable shapes may be used. In some embodiments, all projections have the same shape, size, or density. For example, all projections may have a circular cylindrical shape, having a circular cross section (see, for example, projections 806 of FIG. 8). Also for example, all projections may have an oval cylindrical shape, having an oval cross section (see, for example, central projections 1902, lateral projections 1904, and medial projections 1906 of FIGS. 24-26) All projections, however, need not be of the same shape, size, or density. For example, central projections (e.g., central projections 1802 of FIG. 23) may have a different shape than medial or lateral projections (e.g., medial projections 1806 or lateral projections 1804 of FIG. 23).

Figure 2:
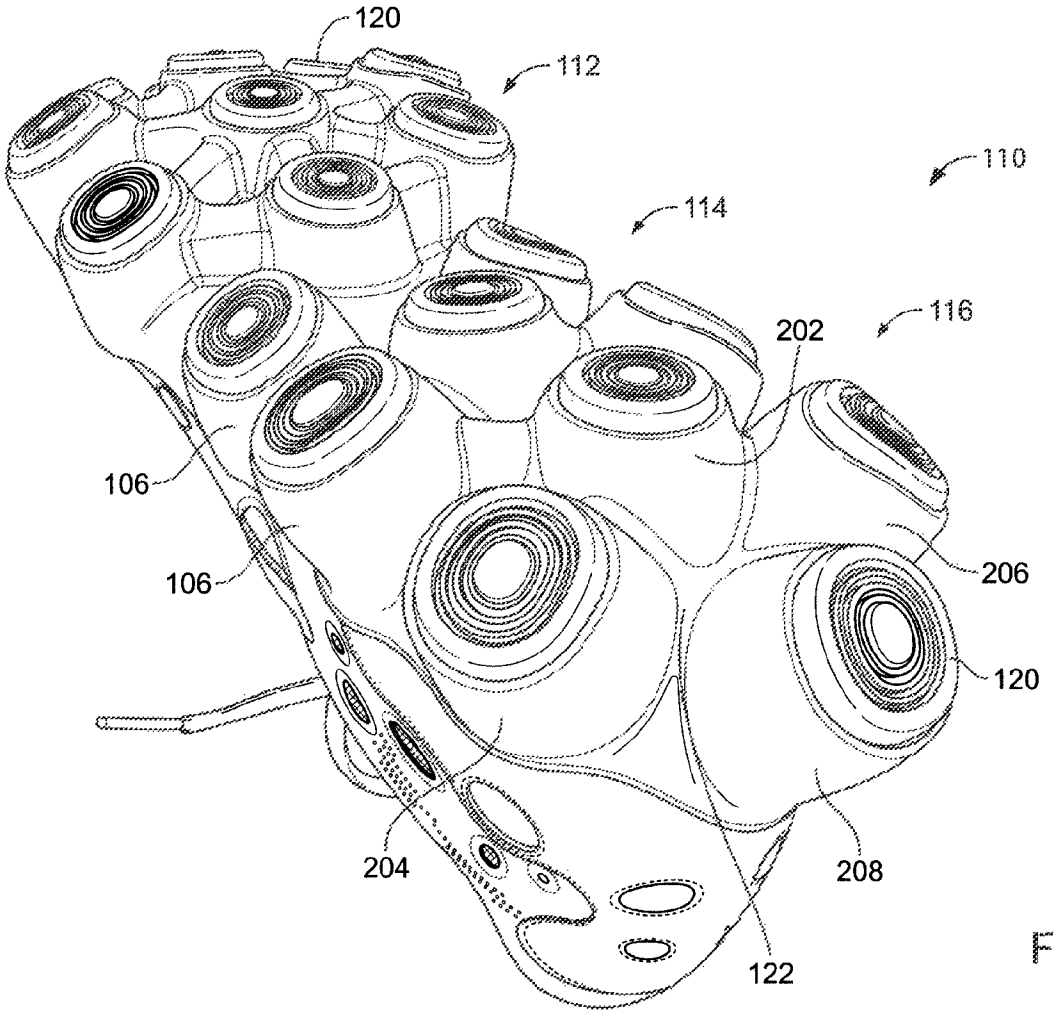
FIG. 2 is a bottom perspective view of the exemplary article of footwear of FIG. 1 according to an embodiment of the present invention.
Figure 20:
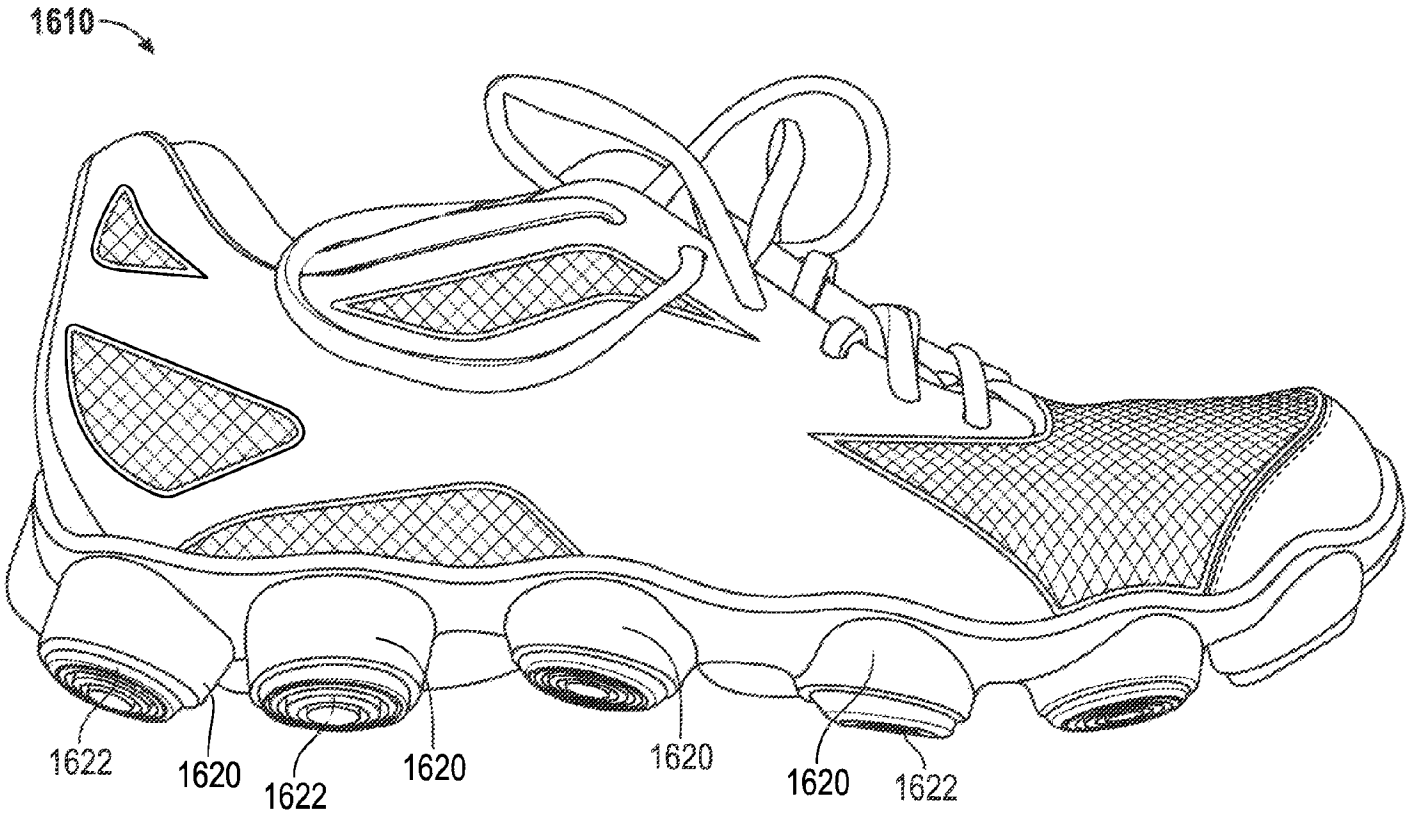
FIG. 20 is a lateral side view of an article of footwear according to an embodiment of the present invention.
Figure 21:
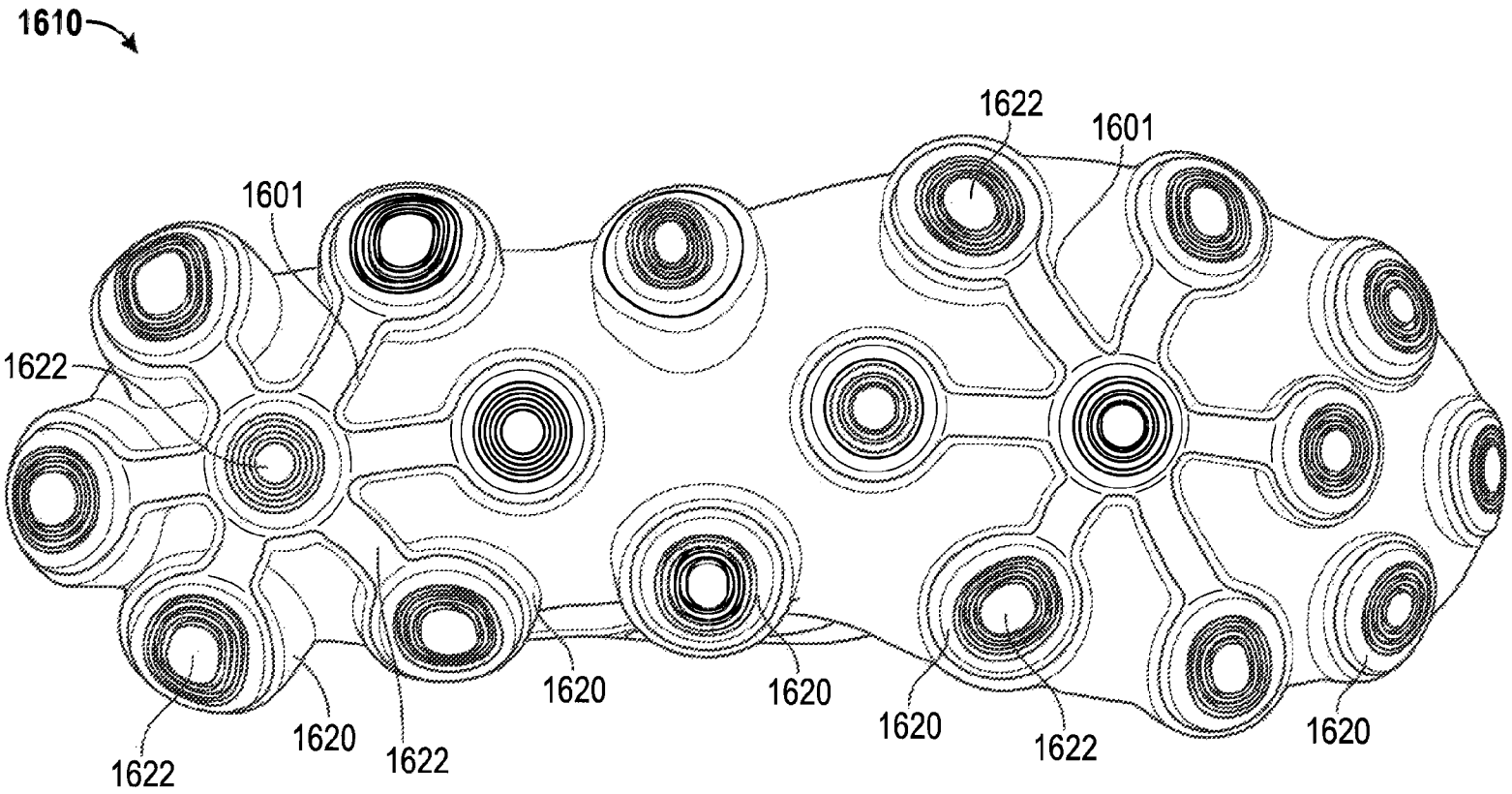
FIG. 21 is a bottom view of the article of footwear of FIG. 20 according to an embodiment of the present invention.
Figure 22:
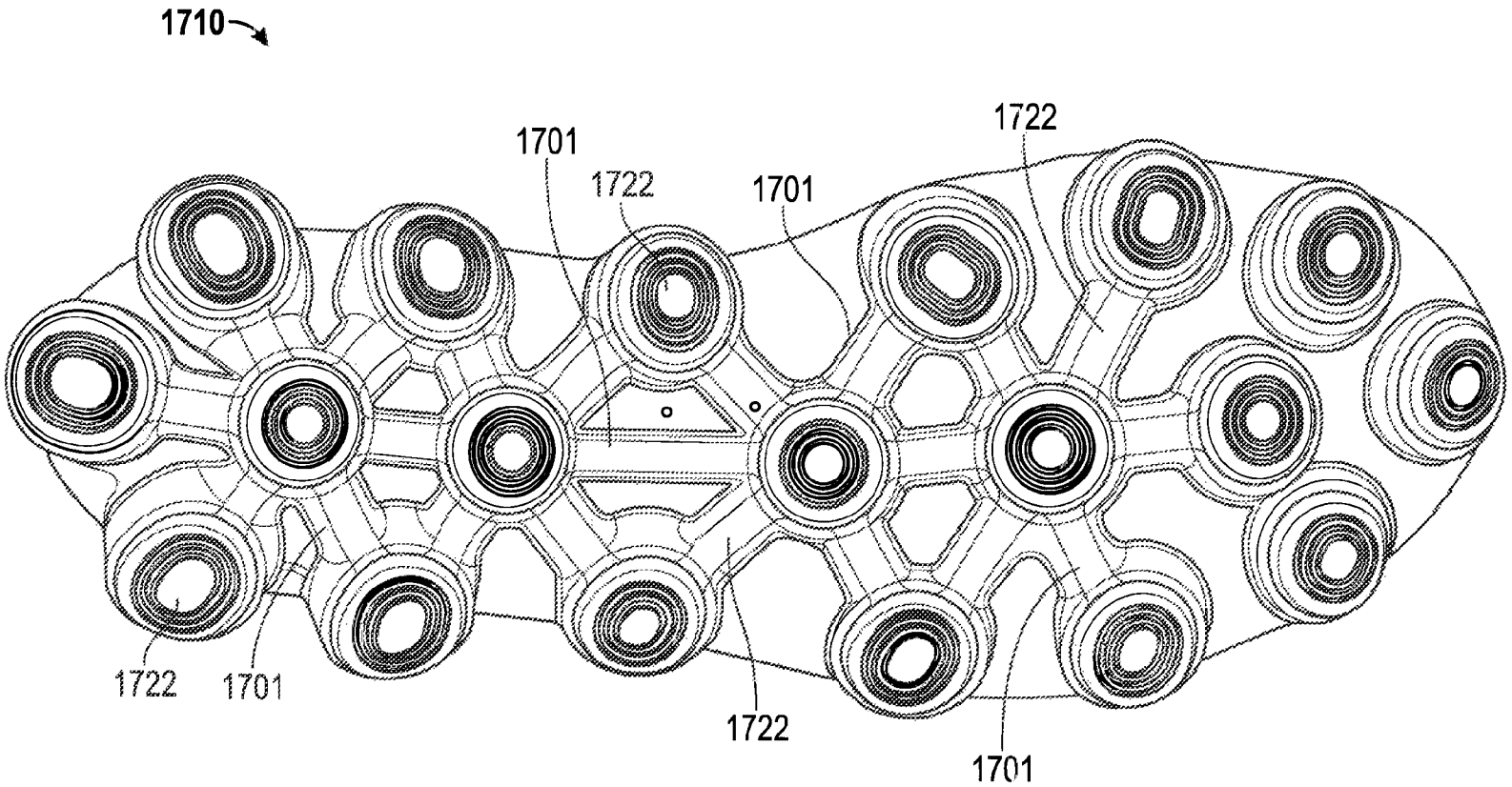
FIG. 22 is a bottom view of an exemplary sole according to an embodiment of the present invention.
Figure 24:
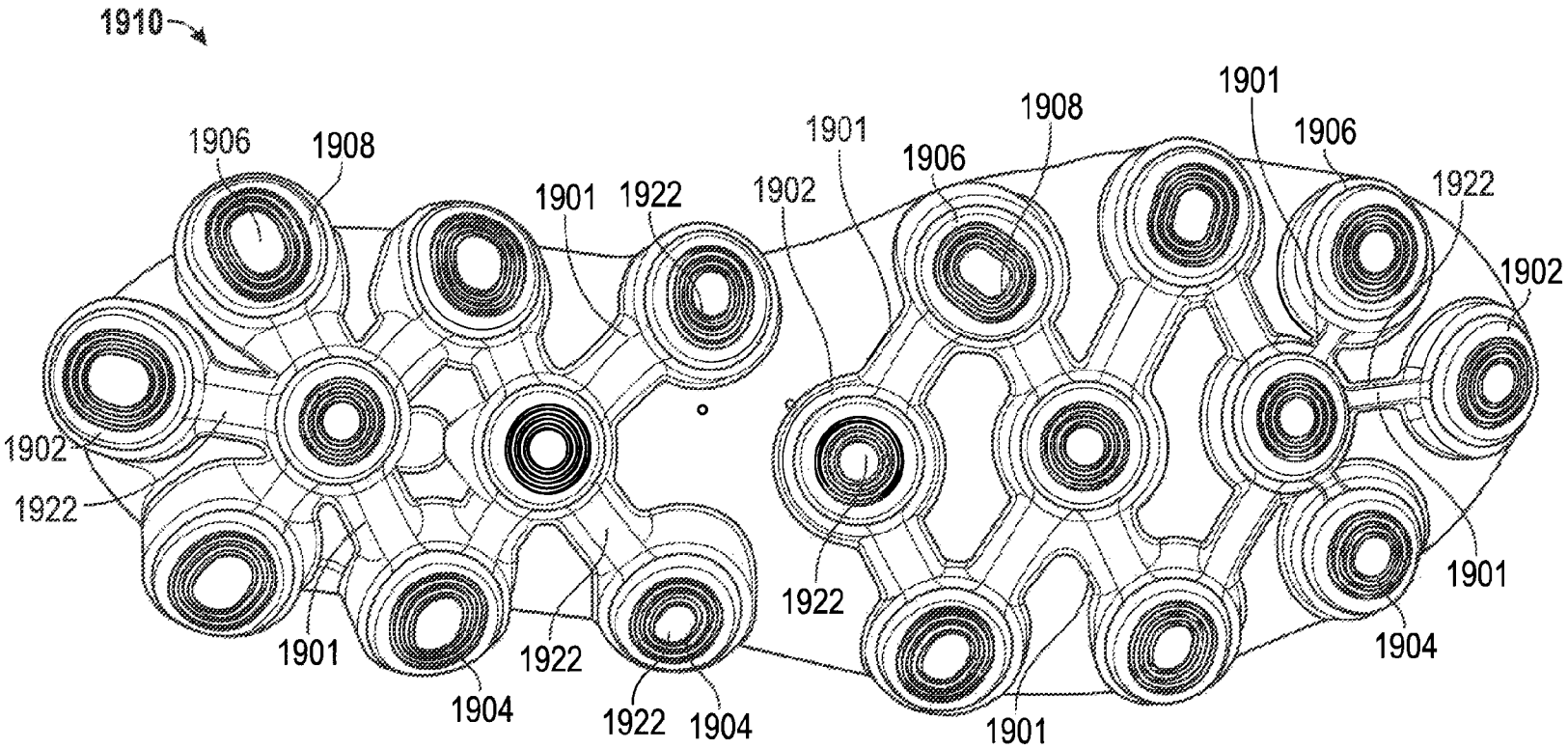
FIG. 24 is a bottom view of an exemplary sole according to an embodiment of the present invention.
Figure 25:
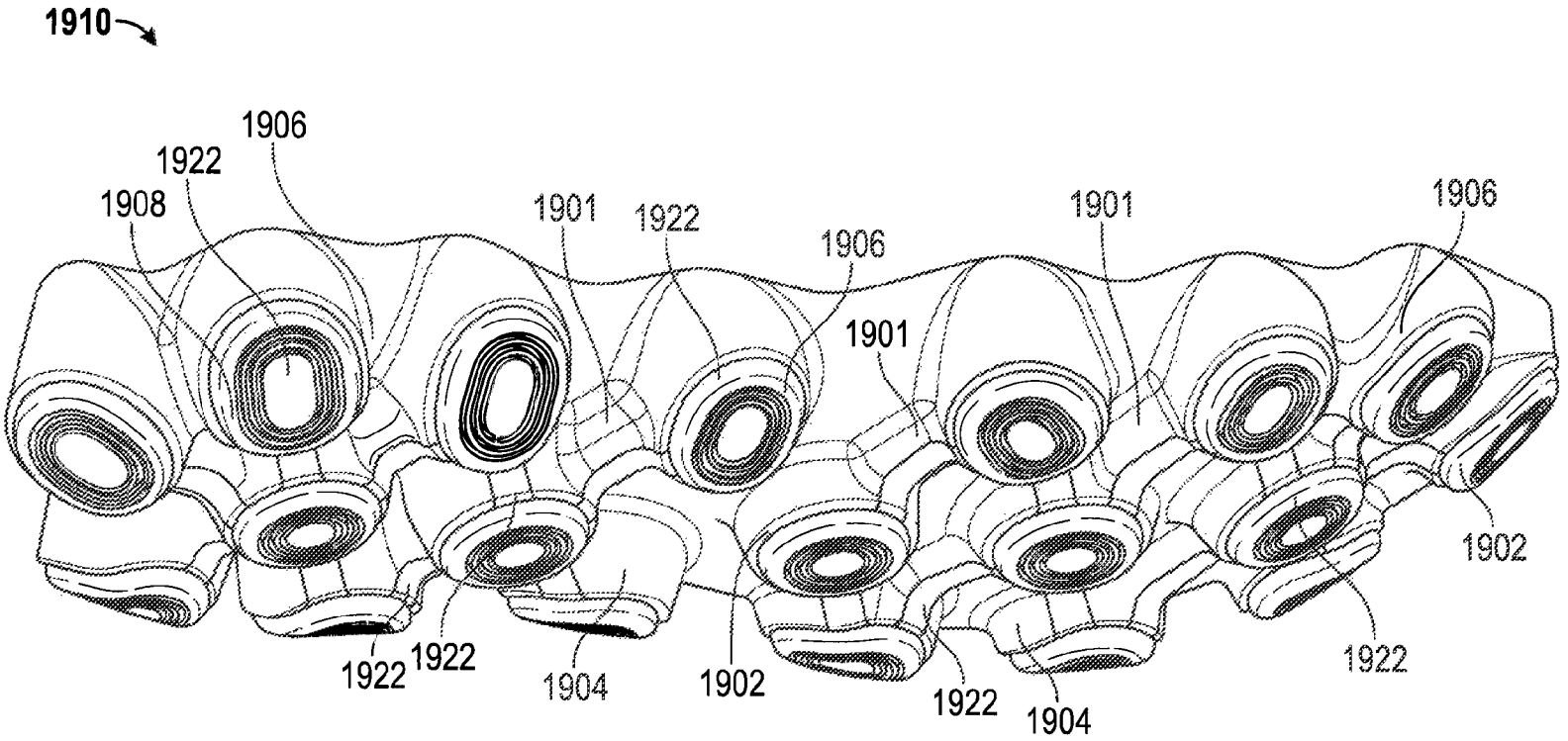
FIG. 25 is a bottom medial side perspective view of the sole of FIG. 24 according to an embodiment of the present invention.
Figure 26:
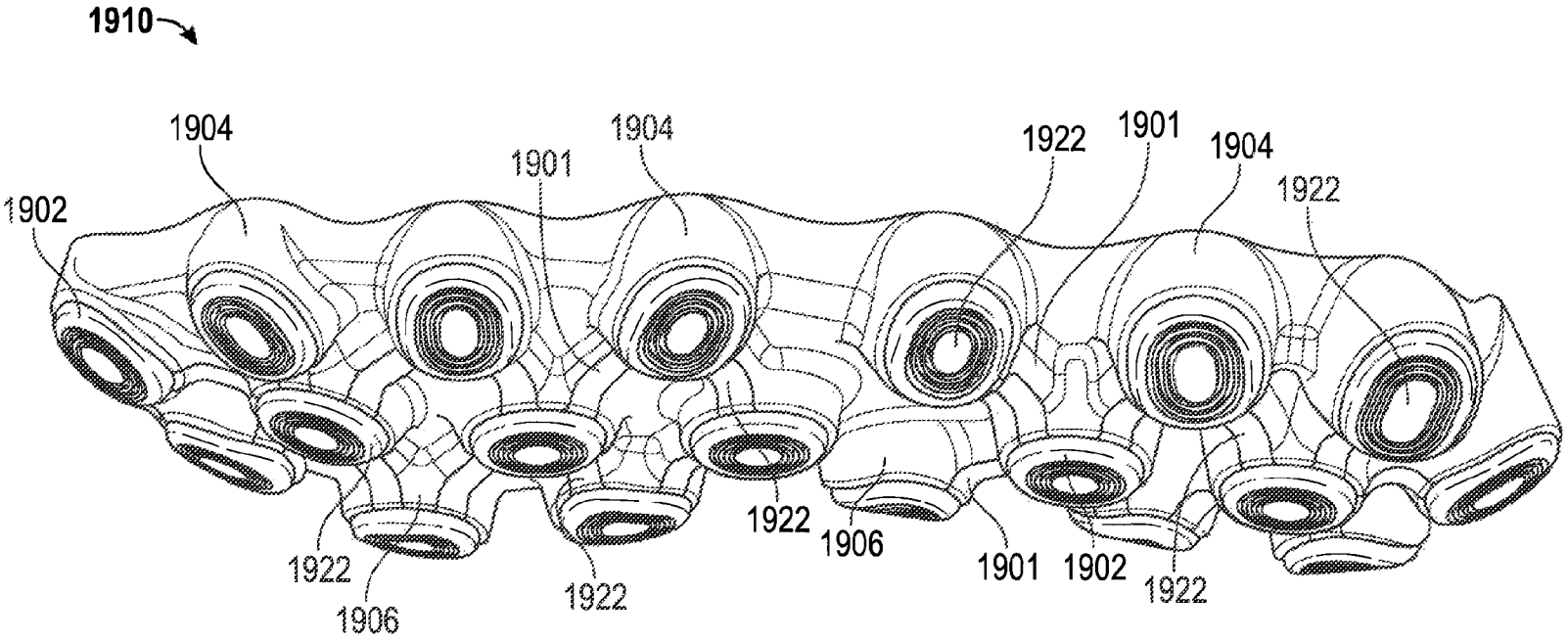
FIG. 26 is a bottom lateral side perspective view of the sole of FIG. 24 according to an embodiment of the present invention.
Figure 27:
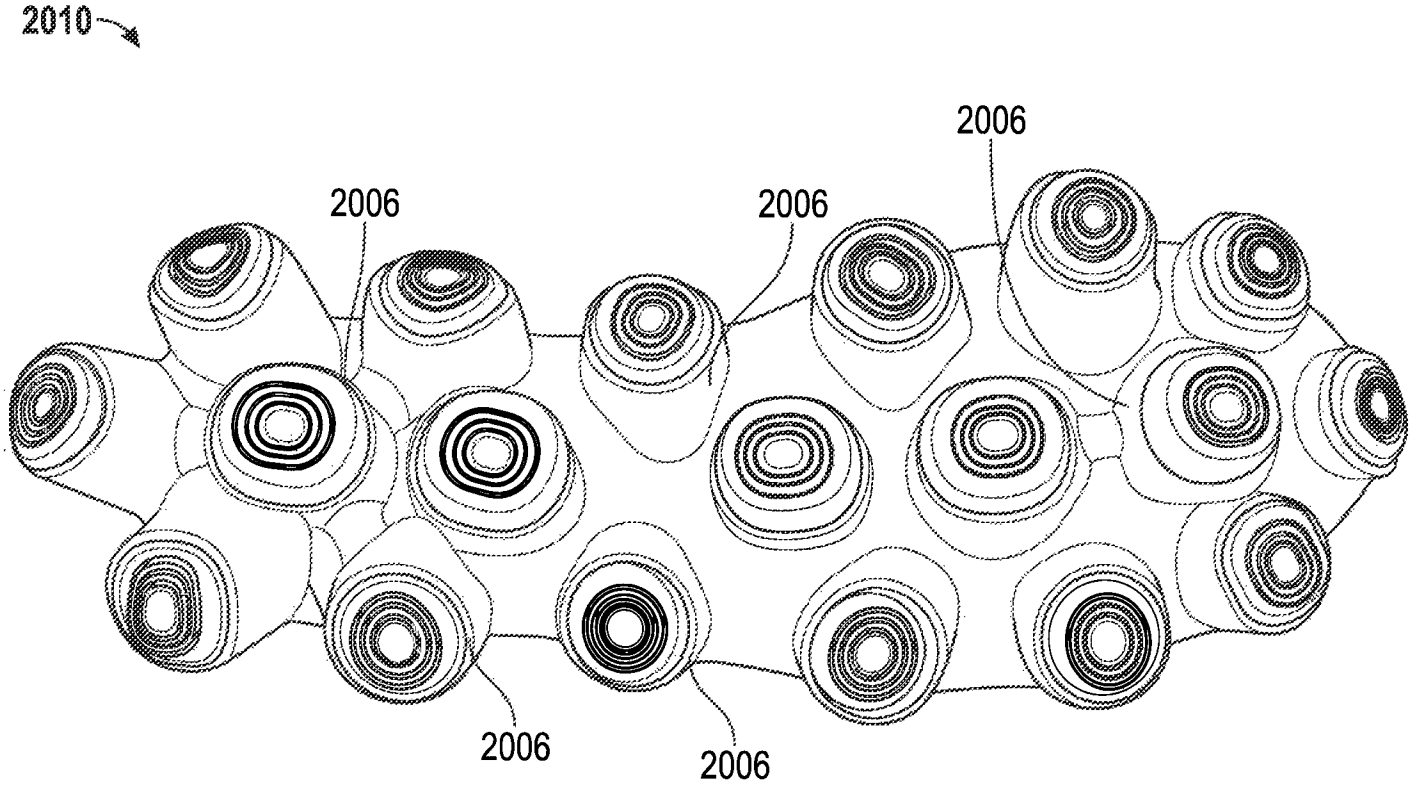
FIG. 27 is a bottom view of an exemplary sole according to an embodiment of the present invention.
Figure 28:
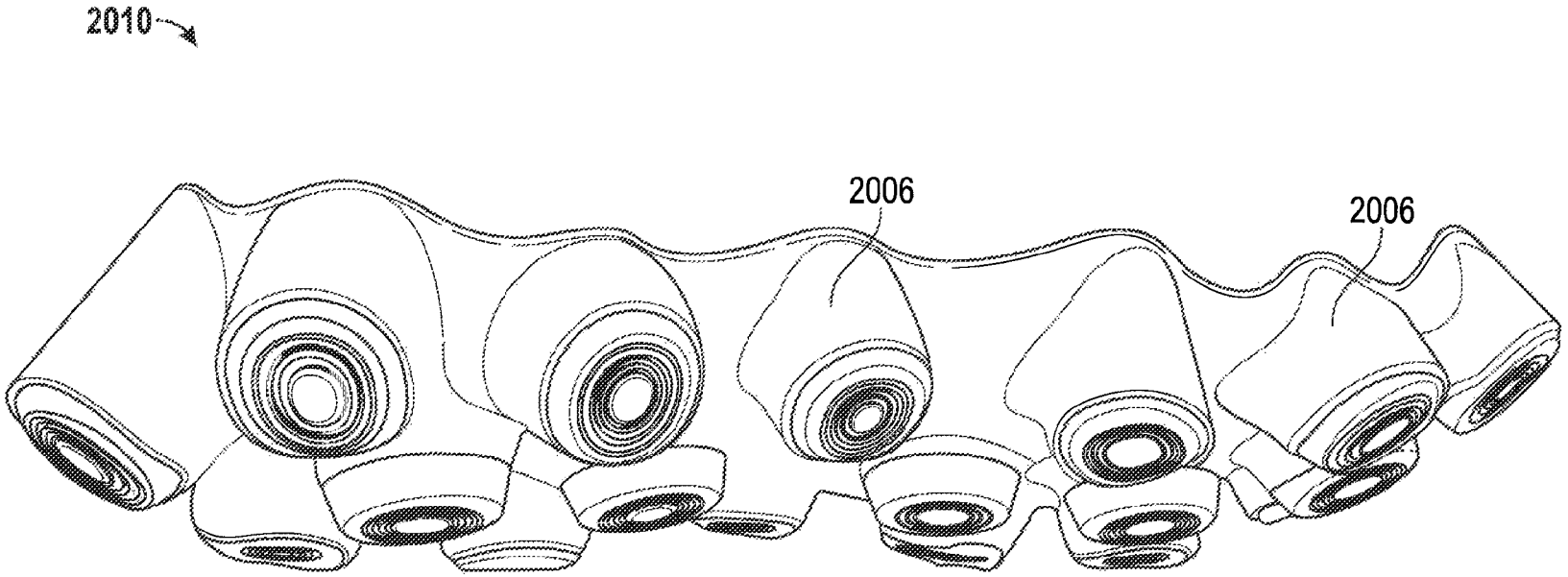
FIG. 28 is a bottom medial side perspective view of the sole of FIG. 27 according to an embodiment of the present invention.

Outsole material 120 can be provided on the lower surface of projections 106 to provide increased wear resistance and traction during use. Although shoe 100 is shown in some embodiments (see, e.g., FIGS. 2-4) with outsole material 120 on every projection 106, it is understood that outsole material 120 can be provided only on selected projections 106 or on none of the projections 106. (For example, outsole material 1622 is shown on only selected projections 1620 in the sole 1610 of FIGS. 20 and 21.) As shown in FIG. 2, projections 106 include lateral projections 204 extending from the lateral side of sole main body 122, medial projections 206 on the medial side of sole main body 122, and central projections 202 formed generally along the longitudinal axis of sole main body 122. A rearmost central projection, referred to herein as heel projection 208, can extend from the heel of the shoe. Although shoe 100 is described herein as including a sole main body 122 from which projections 106 extend, it is understood that shoe 100 can be provided with no sole main body. For example, a plate formed of thermoplastic, graphite, carbon, or similar materials can be provided underneath upper 102, and projections 106 can extend from the plate. Projections (whether terminating in outsole material or not) may terminate in an essentially planar surface, or in a non-planar surface. For example, as shown in FIGS. 24 and 25, some projections (in this case, medial projections 1906) may terminate in a bi-planar surface, including two essentially planar surfaces meeting at a juncture (e.g., juncture 1908) at a non-zero angle.

As shown in FIG. 1, in one embodiment projections 106 may have a longer length in the heel portion 116 of the shoe 100. Shorter projections 106 can be provided in the forefoot portion 112 of the shoe 100. The projections 106 in the midfoot portion of the shoe 100 can be of a length such that when the shoe 100 is resting on a surface, with no pressure applied to the sole 110 of the shoe 100, the projections 106 in the midfoot portion 114 of the shoe 100 do not contact the surface. Sole 110 can be designed such that each projection 106 contacts or engages the ground separately when a user is walking, running, or, more generally, moving under his or her own power. As each projection 106 contacts or engages the ground a compressive force is exerted on the particular projection. When such compressive forces are applied, the projections 106 can provide varying amounts of cushioning and stability depending on the diameter, length, density, and shape of the particular projection 106. The material from which a particular projection 106 is formed can also affect the cushioning and stability provided by the projection, allowing these properties to be further refined according to the location of the projection 106 on the sole 110.

FIG. 2 depicts a bottom perspective view of the exemplary article of footwear of FIG. 1. As best shown in FIG. 2, in one embodiment projections 106 may extend from the main body 122 of sole 110 at different angles according to the position of the projection 106 on sole 110. For example, as shown in FIG. 2, lateral projections 204 and medial projections 206 can be angled away from the longitudinal axis of sole 110, while central projections 202, other than heel projection 208 and the forwardmost central projection, best shown in FIGS. 3 and 4, extend substantially perpendicular from sole main body 122. Heel projection 208 extends at an angle from the rear of main body 122. The lateral and medial projections 204 and 206 can be angled in either a longitudinal or transverse direction, or any combination of longitudinal and transverse angles. Central projections 202 can also be angled in any direction. Angling lateral projections 204 and medial projections 206 away from the longitudinal axis of sole 110 allows for increased ground contacting surface when a wearer is running at a non-perpendicular angle to a surface, for example, when a user is leaning into a turn. Also, the extent to which lateral projections 204 and medial projections 206 are angled away from the longitudinal axis can influence the ability of shoe 100 to resist relative horizontal movement between the sole main body 122 and the lower ends of the projections 106. In some embodiments, such angles can be skewed (e.g., medially or laterally) to further alter the resistance of projections 106). These angles can be tailored to achieve desired resistance.

The vertical height of lateral projections 204, medial projections 206, and central projections 202 may be tailored such that the vertical height of central projections 202 at any point along the sole 110 is greater than the vertical height of lateral and medial projections 204 and 206. In this manner, when shoe 100 is placed on a flat surface, the vertical height of the central projections 202 can be such that the lateral projections 204 and medial projections 206 do not contact the surface. As used herein, the term vertical height refers to the orthogonal distance that a projection extends when the shoe 100 is placed on a flat surface. Thus, for example, although lateral projections 204 and medial projections 206 may have an absolute length that is greater than the absolute length of central projections 202, central projections 202 can have a greater vertical height than lateral projections 204 and medial projections 206 if lateral projections 204 and medial projections 206 extend non-orthogonally from sole main body 122. One skilled in the art would understand that because lateral projections 204 and medial projections 206 are positioned non-orthogonally, the vertical height of lateral projections 204 and medial projections 206 is less than the absolute length of lateral projections 204 and medial projections 206.

In embodiments where central projections 202 have a greater vertical height than lateral and medial projections 204 and 206, the sole 210 generally defines a convex curve when the sole 210 is viewed from the rear. The generally convex shape and steady curvature of sole 210, together with the resiliency provided by the projections 106, may create a controlled rocking motion, or instability, during the gait cycle in a medial to lateral direction.

The difference in the vertical height of lateral and medial projections 204 and 206 and central projections 202 at any point along the sole 110 can be varied. For example, in the forefoot portion 112 of the sole 110, the lateral and medial projections 204 and 206 can have a greater vertical height than the central projections 202, while in the heel portion 116 of sole 110 the lateral and medial projections 204 and 206 have a lower vertical height than the central projections 202. The vertical height of the lateral and medial projections 204 and 206 and central projections 202 can also be the same or substantially the same. Furthermore, it is understood that the vertical height of the lateral and medial projections 204 and 206 need not be the same, and can be varied relative to each other as desired to tailor gait characteristics of the shoe 100 as desired for a particular use. The angles at which projections 106 extend from sole main body 122 can be varied from the angles shown with reference to shoe 100. For example, the angles can be greater than shown in FIG. 2. Also for example, all projections 106 on the shoe can be formed so as to project generally perpendicularly from sole main body 122. In a preferred embodiment, the heel portion 116 of sole 110 has lateral projections 204 that have a greater vertical height than the medial projections 206. In one embodiment, this construction may facilitate a proper gait, which begins at heel strike on the rear lateral side of sole 110 and gradually transitions across the shoe towards the medial portion of the sole 110 in the forefoot portion 112 during the gait cycle.

Figure 3:
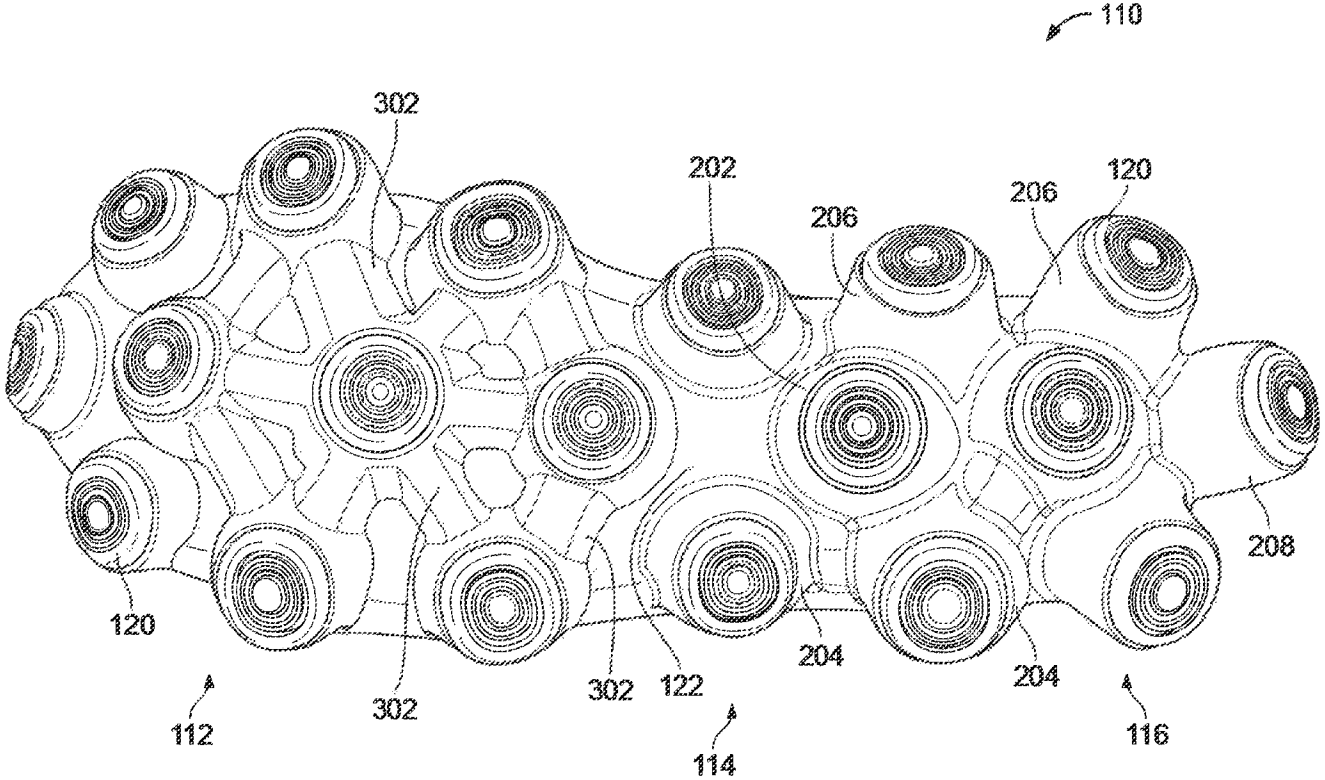
FIG. 3 is a bottom view of the exemplary article of footwear of FIG. 1 according to an embodiment of the present invention.
Figure 4:
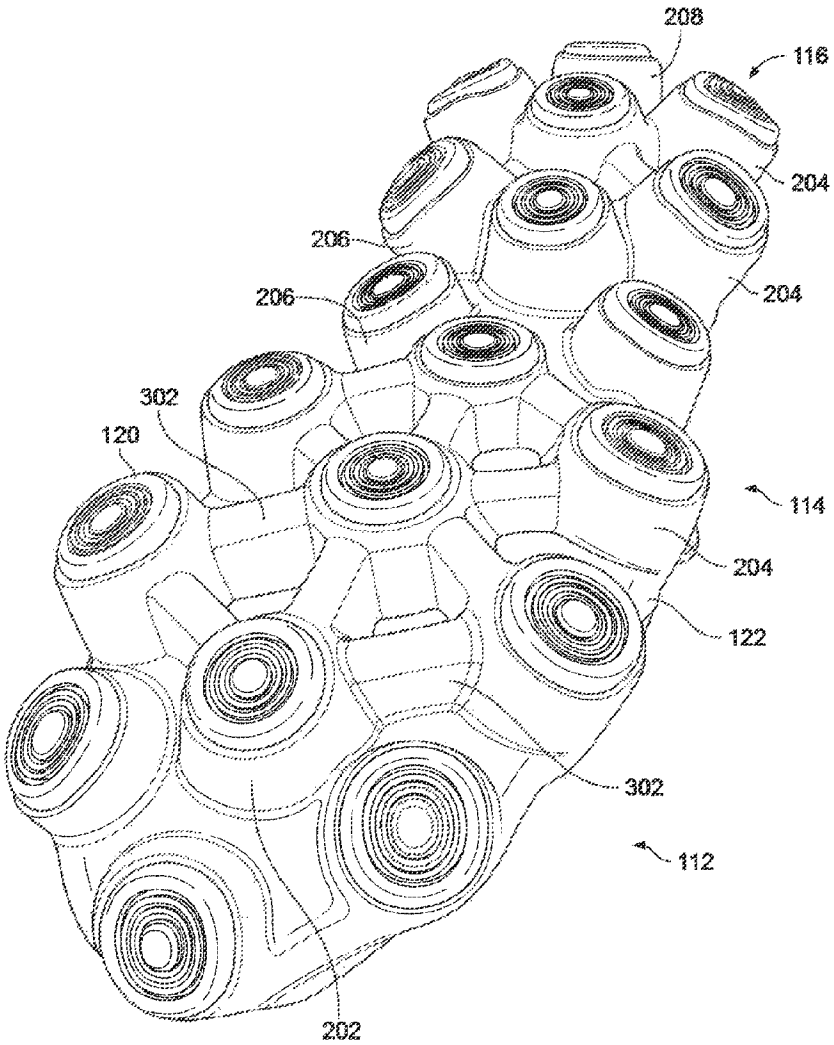
FIG. 4 is a second bottom perspective view of the exemplary article of footwear of FIG. 1 according to an embodiment of the present invention.

FIGS. 3 and 4 depict bottom views of the shoe 100. As shown in FIGS. 3 and 4, bridge elements 302 can be formed between all or some of projections 106. Because lateral and medial projections 204 and 206 are angled away from the longitudinal axis of sole 110, they may splay outwardly from the longitudinal axis of the sole 110 when a generally vertical force is applied to the sole, for example, when a wearer of the shoe is walking or running. Such splaying can be beneficial to the performance of shoe 100. For example, splaying of one or more projections 106 can absorb shear forces, including a combination of shear and vertical forces. In this way, splaying can promote traction of shoe 100, for example, on a track about which a wearer is running (e.g., by allowing sole main body 122 and upper 102, containing the wearer's foot, to move relative to the lower end of a projection 106, while the projection 106 maintains purchase on the ground). The extent of such splaying can be controlled to tailor shoe 100 to a particular function or environment. Further, projections 106 can provide varying amounts of cushioning and stability, and to allow varying degrees of splay, depending on characteristics such as, for example, the diameter, length, density, and shape of the particular projection 106. The material from which a particular projection 106 is formed can also be varied to affect the cushioning, stability, and splay provided by the projection 106, allowing these properties to be further refined as desired.

In some embodiments, bridge elements 302 can control (e.g., limit) splaying by anchoring certain lateral and medial projections 204 and 206 to one or more nearby projections 106 (e.g., central projections 202). Bridge elements 302 can also directly connect two or more central projections 202. Although not shown in FIGS. 3 and 4, bridge elements 302 could also be formed so as to directly connect lateral and medial projections 204 and 206. This direct connection of lateral and medial projections 204 and 206 would also restrict the splaying effect of lateral and medial projections 204 and 206.

In some embodiments, bridge elements 302 may be monolithic with main body 122 or projections 106, or may be separate elements affixed thereto. For example, bridge elements 302 may be extensions of main body 122. Bridge elements 302 may have a material composition having greater or lesser rigidity than main body 122 or projections 106. The geometry (e.g., size, shape, depth) and position of bridge elements 302 may be varied as desired. These and other characteristics may affect the extent to which bridge elements 302 limit splaying of projections 106.

With reference to FIG. 3, in one embodiment a plurality of bridge elements 302 may extend radially outward from a centrally located projection 202 so as to provide a hub-and-spoke arrangement. For example, a central projection 202 located in the forefoot of the sole 110 may include six bridge elements 302 extending radially outward from the projection 202. In one embodiment, one or more of the projections 106 to which the bridge elements 302 connect may be further connected to one or more other projections 106 with additional bridge elements 302. Such a hub-and-spoke arrangement can be used to control (e.g., reduce or prevent) splaying of projections 106, which can be tailored as desired by varying the form of bridge elements 302 (e.g., as described above). For example, the arrangement can provide resistance to horizontal forces, thereby vertically focusing the cushioning of projections 106. Further, because the bridge elements 302 of a hub-and-spoke arrangement are interconnected, production may be simplified, requiring manufacture and assembly of fewer individual parts.

Figure 18:
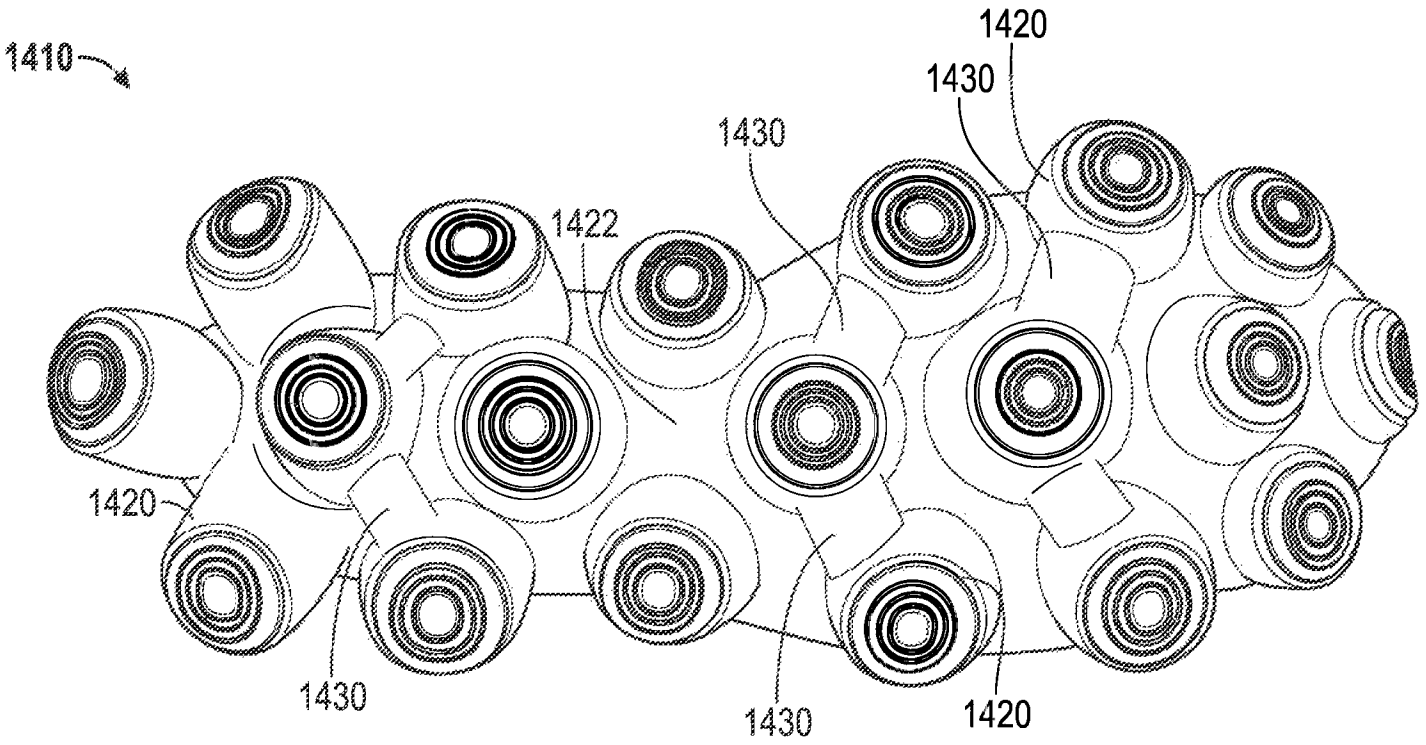
FIG. 18 is a bottom view of an exemplary sole according to an embodiment of the present invention.

In some embodiments, bridge elements can be formed by raised portions of a main body of a sole. For example, FIG. 18 depicts an exemplary embodiment including a sole 1410, wherein portions of a main body 1422 are raised to form bridge elements 1430 between projections 1420.

Figure 19:
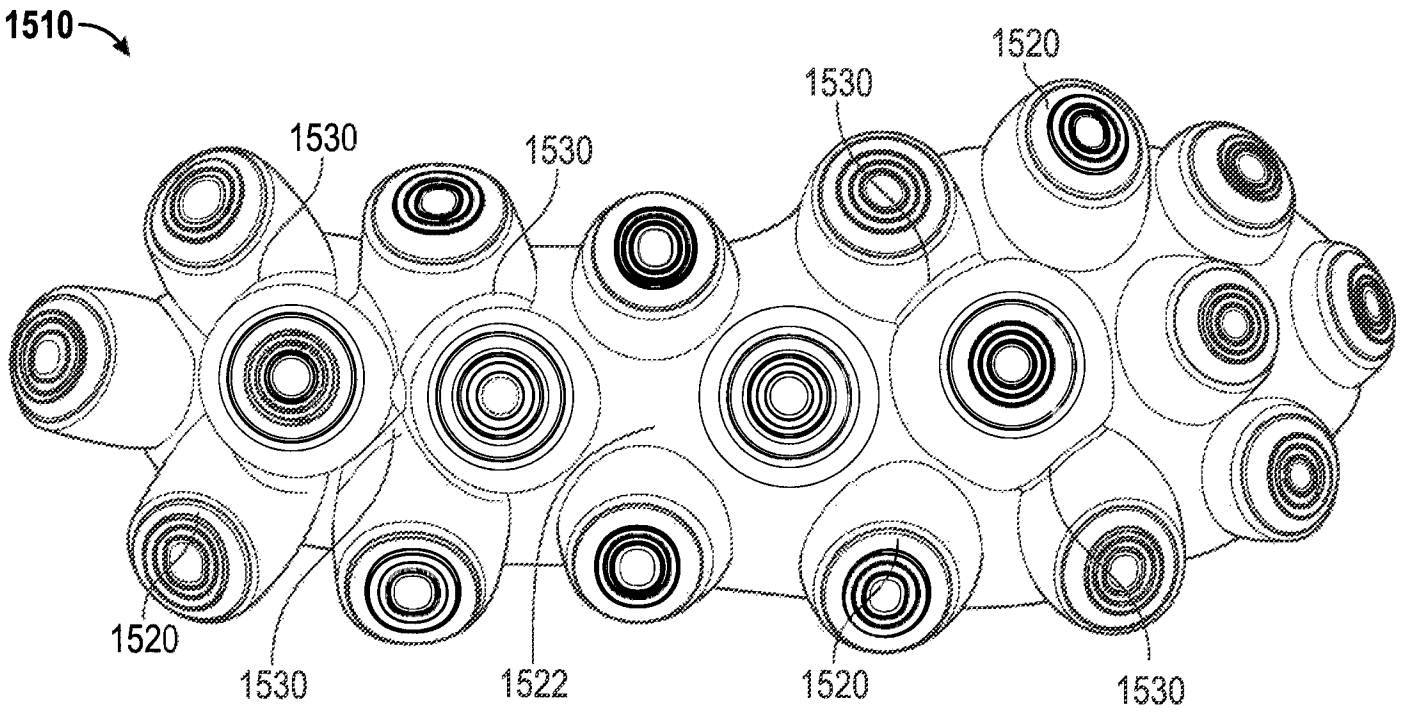
FIG. 19 is a bottom view of an exemplary sole according to an embodiment of the present invention.

In some embodiments, natural bridge elements can be formed by the overlap of adjacent projections. For example, the outer surface of projections positioned adjacent one another, having sufficiently large diameters, may intersect, thereby forming natural bridge elements. FIG. 19 depicts an exemplary embodiment including a sole 1510, wherein adjacent projections 1520 form natural bridge elements 1530.

Figure 5:
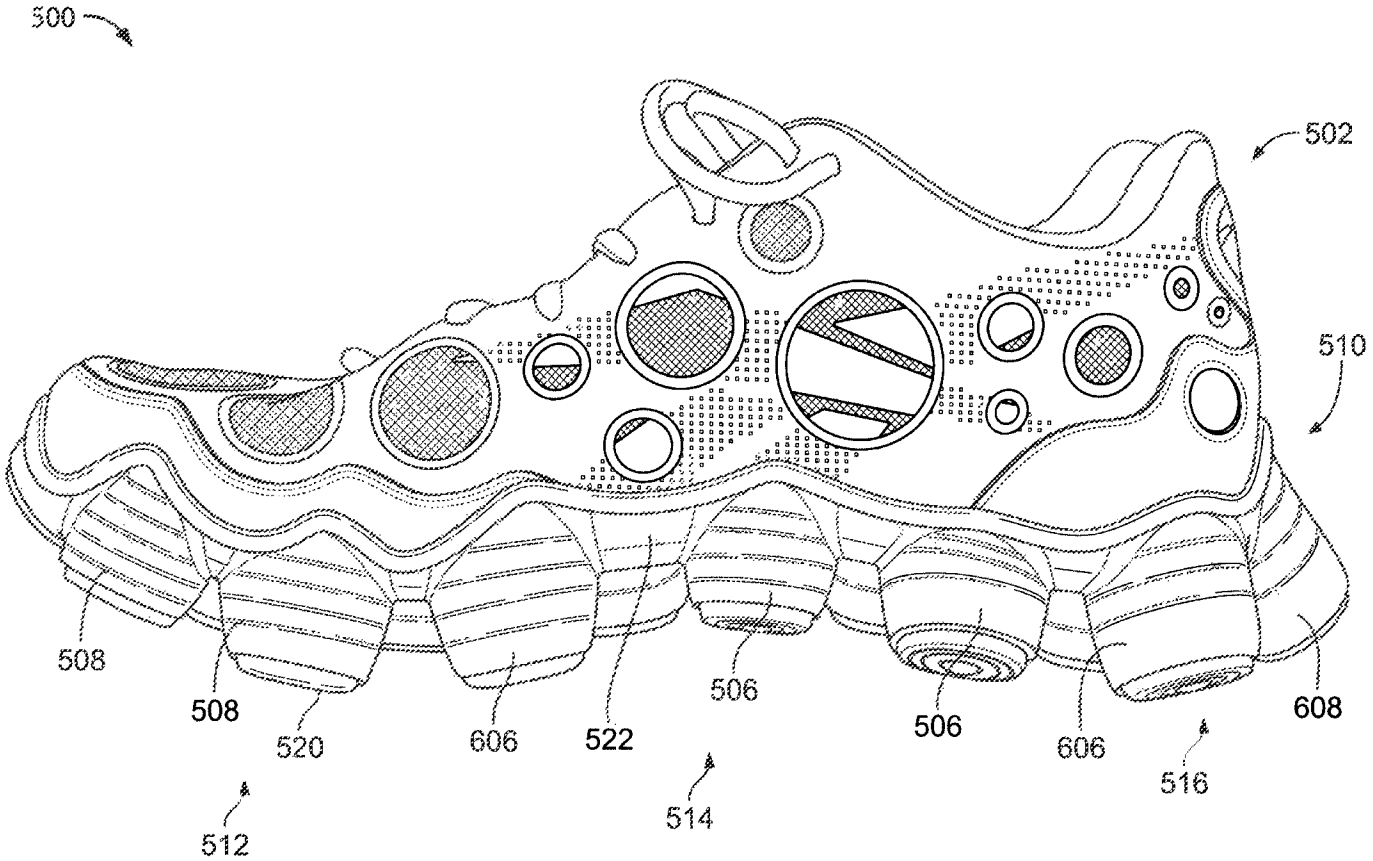
FIG. 5 is a medial side view of an exemplary article of footwear according to another embodiment of the present invention.

FIG. 5 is a medial side view of an article of footwear 500 according to another embodiment of the present invention. Although the article of footwear 500 may be referred to herein as shoe 500, it is contemplated that it may comprise any type of footwear in which the sole of the present invention may be desirable, including, but not limited to, walking shoes, running shoes, basketball shoes, court shoes, tennis shoes, training shoes, boots, and sandals.

The shoe 500 has a forefoot portion 512, a midfoot portion 514, and a heel portion 516. The shoe 500 includes an upper 502 and a sole 510. The upper 502 may be formed to generally accommodate a human foot, and may comprise one or more textiles made of natural or man-made fibers. Materials appropriate for the upper 502 including, but not limited to, leather, rubber, and plastic, are considered to be within the scope of the present invention.

Sole 510 can also include outsole material 520 as a ground contacting material. In one embodiment of the present invention, an insole and/or sockliner may also be included within the shoe 500. In some embodiments, the sole 510 may include an insole and/or sockliner. Sole 510 and outsole material 520 can be formed of a variety of materials, for example, the materials described above with reference to FIGS. 1-4.

Figure 6:
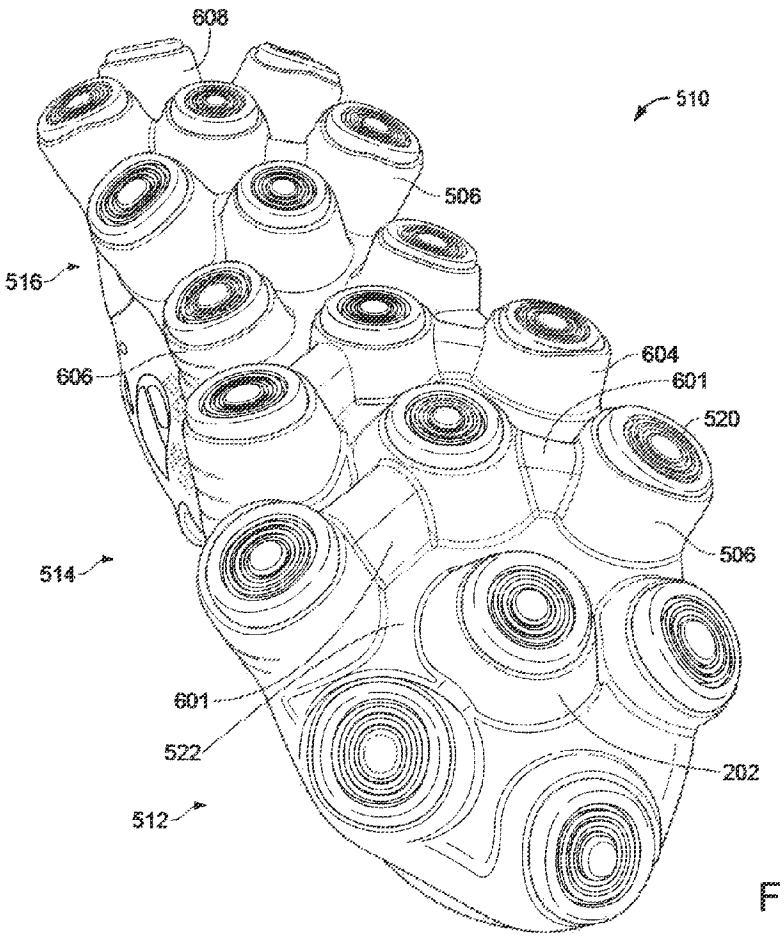
FIG. 6 is a bottom perspective view of the exemplary article of footwear of FIG. 5 according to an embodiment of the present invention.

The sole 510 of shoe 500 includes projections 506 extending downwardly from the main body 522 of the sole 510. Projections 506 can be formed in a variety of shapes, sizes, and densities in order to provide cushioning and weight properties that are tailored to specific areas of the sole 510. Outsole material 520 can be provided on the lower surface of projections 506 to provide increased wear resistance and traction during use. Although shoe 500 is shown in the figures with outsole material 520 on every projection 506, it is understood that outsole material 520 can be provided only on selected projections 506 or none of the projections 506. As shown in FIG. 6, projections 506 include lateral projections 604 extending from the lateral side of sole main body 522, medial projections 606 on the medial side of sole main body 522, and central projections 602 formed generally along the longitudinal axis of sole main body 522. A rearmost central projection, referred to herein as heel projection 608, may extend from the heel of the shoe. Although shoe 500 is described herein as including a sole main body 522 from which projections 506 extend, it is understood that shoe 500 may be provided with no sole main body. For example, a plate formed of thermoplastic, graphite, carbon, or similar materials can be provided underneath upper 502, and projections 506 can extend from the plate (see, e.g., plates 950, 1050, or 1150, described below). In some embodiments, the plate may be ribbed on its top surface, bottom surface, or both (similar to, for example, longitudinal ribs 1354, discussed below).

As shown in FIG. 5, projections 506 have a longer length in the heel portion 516 and forefoot portion 512 of the shoe 500. Shorter projections 506 may be provided in the midfoot portion of the shoe 500 such that, when the shoe 500 is resting on a flat surface with no pressure applied to the sole 510 of the shoe 500, the projections 506 in the midfoot portion 514 of the shoe 500 do not contact the surface. The forwardmost projections 506 in the forefoot portion 512 of the sole also would not contact the surface when no pressure is applied to the sole 510, as shown in FIG. 5. As a wearer of the shoe 500 transitions to the toe-off phase of a gait cycle, the foot will roll forward bringing the forwardmost projections 506 in the forefoot portion 512 into contact with the ground to allow a user to have traction and cushioning when pushing off the ground. Sole 510 can be designed such that each projection 506 contacts or engages the ground separately when a user is walking, running, or, more generally, moving under his or her own power. As each projection 506 contacts or engages the ground a compressive force is exerted on the particular projection. When such compressive forces are applied, the projections 506 can provide varying amounts of cushioning and stability depending on the diameter, length, density, and shape of the particular projection 506. The material from which a particular projection 506 is formed can also be varied to affect the cushioning and stability provided by the projection 506, allowing these properties to be further refined as desired (e.g., according to the location of the projection 506 on the sole 510).

Figure 7:
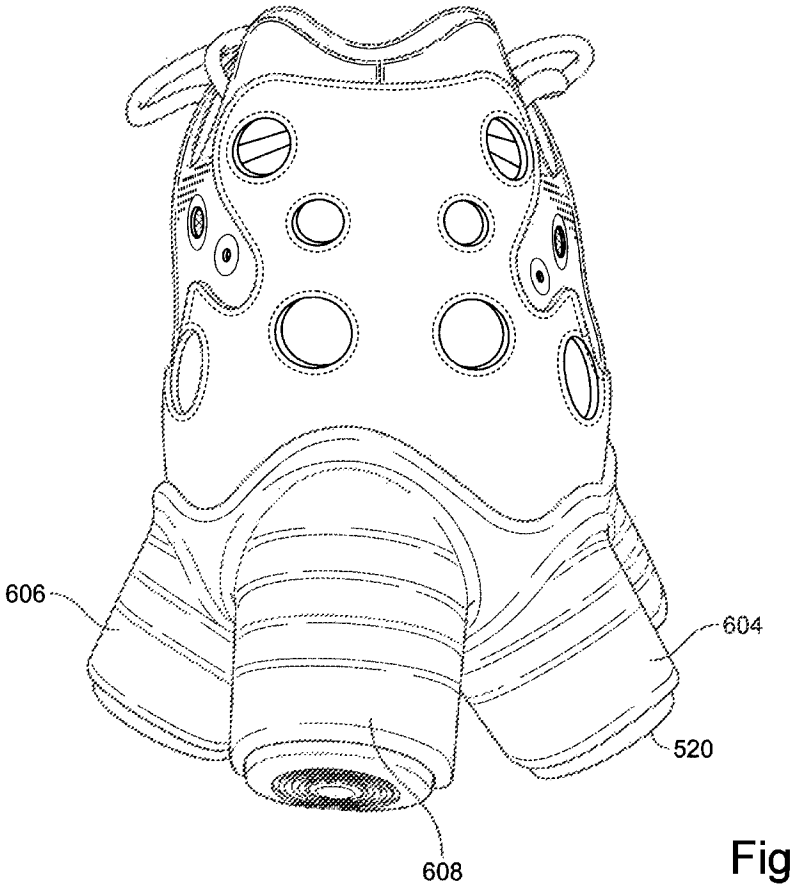
FIG. 7 is a rear view of the exemplary article of footwear of FIG. 5 according to an embodiment of the present invention.

FIG. 6 depicts a bottom perspective view of the exemplary article of footwear of FIG. 5. As best shown in FIG. 6, projections 506 can extend from the main body 522 of sole 510 at different angles according to the position on the projection 506 on sole 510. For example, lateral projections 604 and medial projections 606 can be angled away from the longitudinal axis of sole 510, while central projections 602, other than heel projection 608 and the forwardmost central projection 602 in the threfoot portion 512, may extend substantially orthogonally from sole main body 522. Heel projection 208 extends at an angle from the rear of main body 522. The lateral and medial projections 604 and 606 can be angled in either a longitudinal or transverse direction, or any combination of longitudinal and transverse angles, as shown for example in FIG. 7. Central projections 602 can also be angled in any direction.

The vertical height of lateral projections 604, medial projections 606, and central projections 602 can be tailored such that the vertical height of central projections 602 at any point along the sole 510 is shorter than the vertical height of lateral and medial projections 604 and 606. In this manner, when shoe 500 is placed on a flat surface, the vertical height of the central projections 602 can be such that the central projections 602 do not contact the surface. In a preferred embodiment, the relative vertical height of the lateral projections 604, medial projections 606, and central projections 602 have different correlations at different locations along the sole 510. For example, in the heel portion 516 of the sole 510, the rearmost lateral and medial projections 604 and 606 can have approximately the same vertical height. The second rearmost central projection 602 can be substantially the same vertical height as the rearmost lateral and medial projections 604 and 606. The second rearmost lateral projection 604 can have a greater vertical height than the second rearmost medial projection 606, which can in tarn have a greater vertical height than the third rearmost central projection 602. This configuration encourages the natural gait movement of a human foot. A similar configuration can be provided in the forefoot portion 512 of the shoe to encourage medial rotation of the shoe as the gait progresses to toe-off.

As shown in FIG. 6, bridge elements 601 can be formed between all or some of projections 506. In the embodiment shown in FIG. 6, bridge elements 601 are formed transversely across two rows of projections in the forefoot portion 512 of sole 510. As described above with reference to shoe 100, bridge elements 601 can also directly connect two or more central projections 202. Bridge elements 601 could also be formed so as to directly connect lateral and medial projections 604 and 606. This direct connection of lateral and medial projections 604 and 606 would also restrict the splaying effect of lateral and medial projections 604 and 606. Bridge elements 601 can also be formed between projections in the heel portion 516 or midfoot portion 514 of sole 510.

FIGS. 21-26 show alternate exemplary embodiments of bridge element configurations (e.g., bridge elements 1601, 1701, 1801, 1901 of soles 1610, 1710, 1810, 1910). In the embodiments of FIGS. 21-26, outsole material 1622, 1722, 1822, 1922 is disposed on bridge elements 1601, 1701, 1801, 1901 and projections connected thereby.

In one embodiment, as shown, for example, in FIGS. 8, 9, 27, and 28, in which like reference numerals refer to like elements, a sole 810 may be formed without bridge elements. In such an embodiment, splay can be controlled as described elsewhere herein. For example, by selection of the angles, heights (vertical or absolute), or geometries of one or more projections 106, or of the composition of the materials forming projections 106.

In some embodiments, the presence or configuration of bridge elements may be influenced by the expected use of the shoe, or by the expected wearer of the shoe. For example, a children's shoe is typically made in a smaller size than an adult's shoe, in part because children typically have smaller feet than adults. Children also are typically lighter than adults, and therefore may impart lesser forces on and through projections of a shoe. Thus, smaller shoes (e.g., those intended for children) may have fewer bridge elements than larger shoes (e.g., those intended for adults). In some embodiments a sole for a children's shoe may have no bridge elements (e.g., sole 2010 shown in FIGS. 27 and 28, which has disconnected projections 2006).

Figure 10:
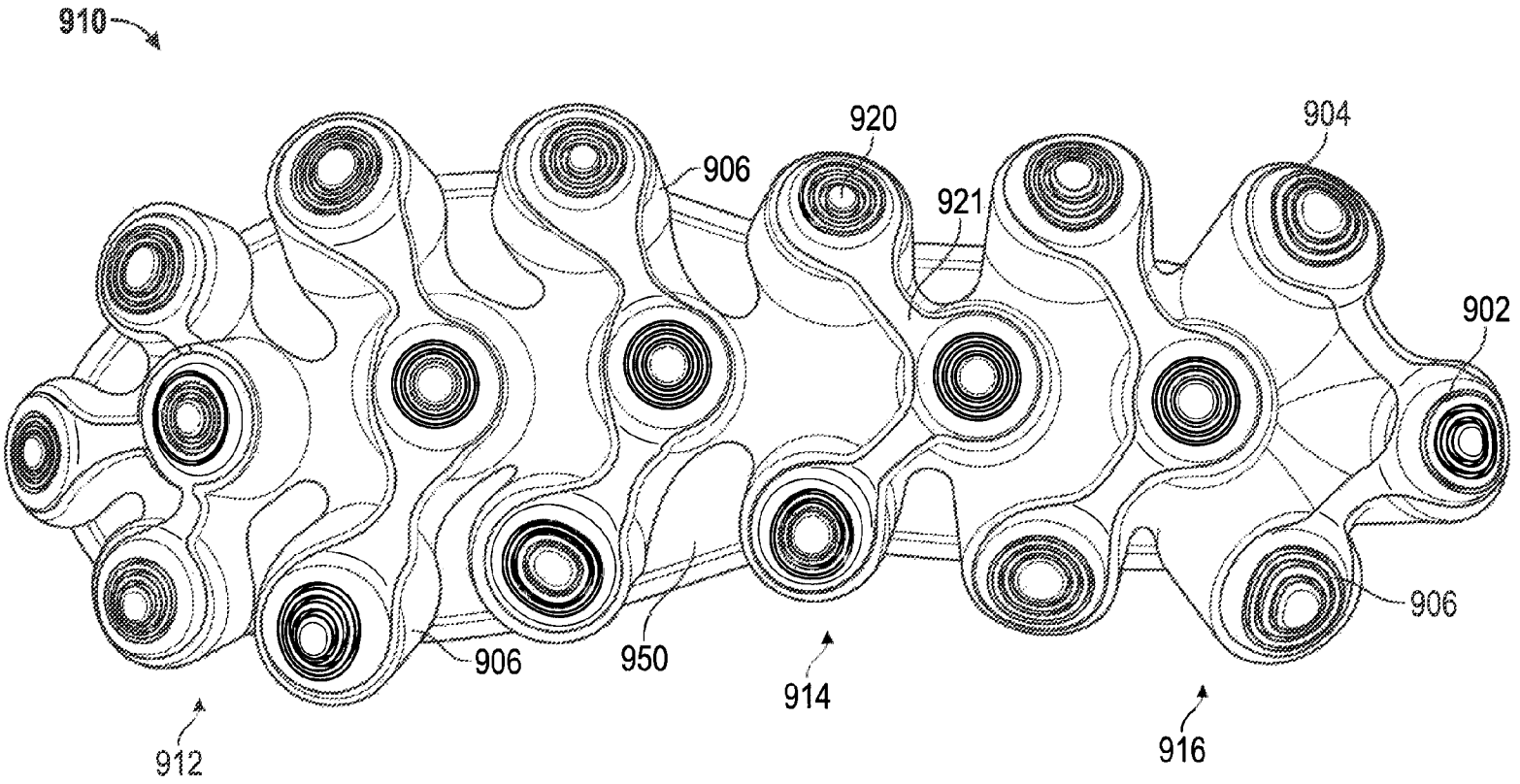
FIG. 10 is a bottom view of a sole having outsole connecting elements according to an embodiment of the present invention.

A sole 910 according to another embodiment of the present invention will now be described with reference to FIG. 10, in which like reference numerals refer to like elements. The sole 910 includes a plurality of projections forming a plurality of V-shaped arrangements. The V-shaped projection arrangements may include a lateral projection 904 and a medial projection 906 connected at a central projection 902, which forms the apex of the V-shaped arrangement. The V-shaped arrangement may focus and promote flexibility in the heel-to-toe direction, and each V-shaped arrangement in sole 910 may be tailored to provide independent (e.g., different) flexibility from other V-shaped arrangements. In one embodiment, the projections may be formed such that the central projection 902 of each V-shaped arrangement is rearward of the connected lateral projection 904 and medial projection 906. Such V-shaped arrangement can be used to control and tailor splaying of projections as desired. For example, the arrangement can provide increased resistance to horizontal forces in a particular direction (e.g., toward the apex of the V-shape) thereby focusing the cushioning of projections in the opposite direction. In one embodiment, sole 910 may include six V-shaped arrangements of projections extending from the heel portion 916 of the sole to the forefoot portion 912. In other embodiments, other suitable configurations may be used. For example, sole 910 may include V-shaped arrangements in only the heel portion 916 or in only the forefoot portion 912. In one embodiment, outsole 920 may include connecting elements 921 that extend between adjacent projections. In such embodiments, because the connecting elements 921 interconnect among more than one projection, production may be simplified, requiring manufacture and assembly of fewer individual parts.

In some embodiments, as shown, for example, in FIGS. 10-14, in which like reference numerals refer to like elements, a sole (e.g., sole 910, 1010, or 1110) having projections as described herein may be formed with a structural plate (e.g., plate 950, 1050, or 1150). Such a structural plate can promote control and limitation of movement of projections. Such a structural plate may be plate formed of thermoplastic, graphite, carbon, or similar materials for example, a thin injection molded or lasting board plate, a tuck board, or a fiber-reinforced polymer plate (e.g., carbon- or glass-fiber)—and may have greater rigidity than a main body (e.g., main body 1022 or 1122) of a sole into which it is incorporated. In some embodiments, the main body may be replaced (completely or in one or more areas) with a structural plate, and projections may be connected directly to the structural plate. A structural plate may impart a degree of relative rigidity to the sole, and may limit or otherwise modulate torsion of the sole and splay of the projections. Further, a structural plate may provide a moderated or uniform feel across the bottom of a sole (e.g., by dispersing localized forces imparted through projections). Parameters (e.g., size, shape, position, and composition) of such a structural plate can be selected as desired to suit a particular use.

Figure 11:
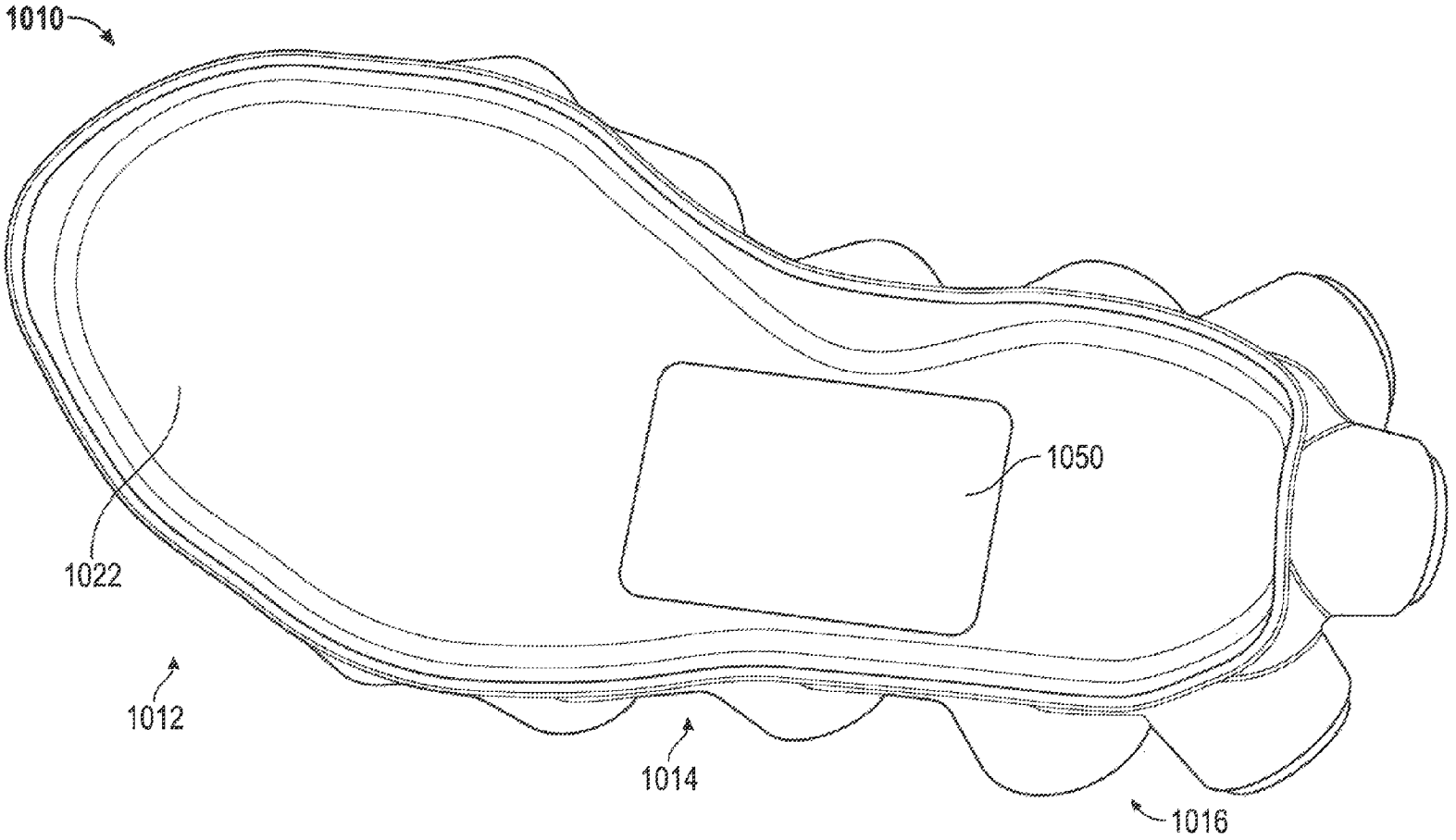
FIG. 11 is a top view of an exemplary sole according to an embodiment of the present invention.
Figure 12:
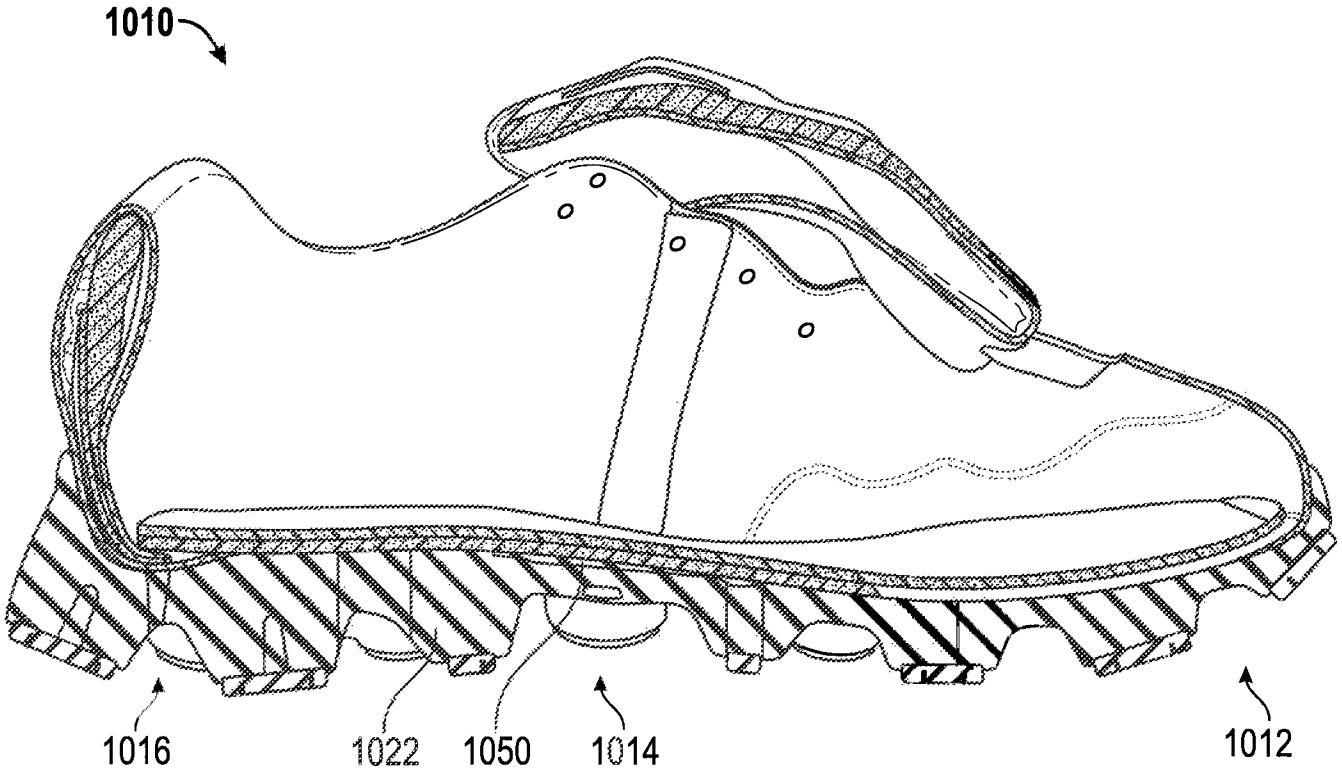
FIG. 12 is a side sectional view of an exemplary article of footwear according to an embodiment of the present invention.

Plate 1050, as shown in FIGS. 11 and 12, may be disposed at a midfoot portion 1014, above a main body 1022 of sole 1010 (e.g., in a corresponding cavity formed in main body 1022). Plate 1050 may be disposed between main body 1022 and an insole of sole 1010, as shown in the cross-sectional view of FIG. 12. Plate 1050 need not be so disposed however, and may be disposed, for example, below main body 1022, or above an insole, or may be disposed in a forefoot portion 1012 or heel portion 1016 of sole 1010.

Figure 13:
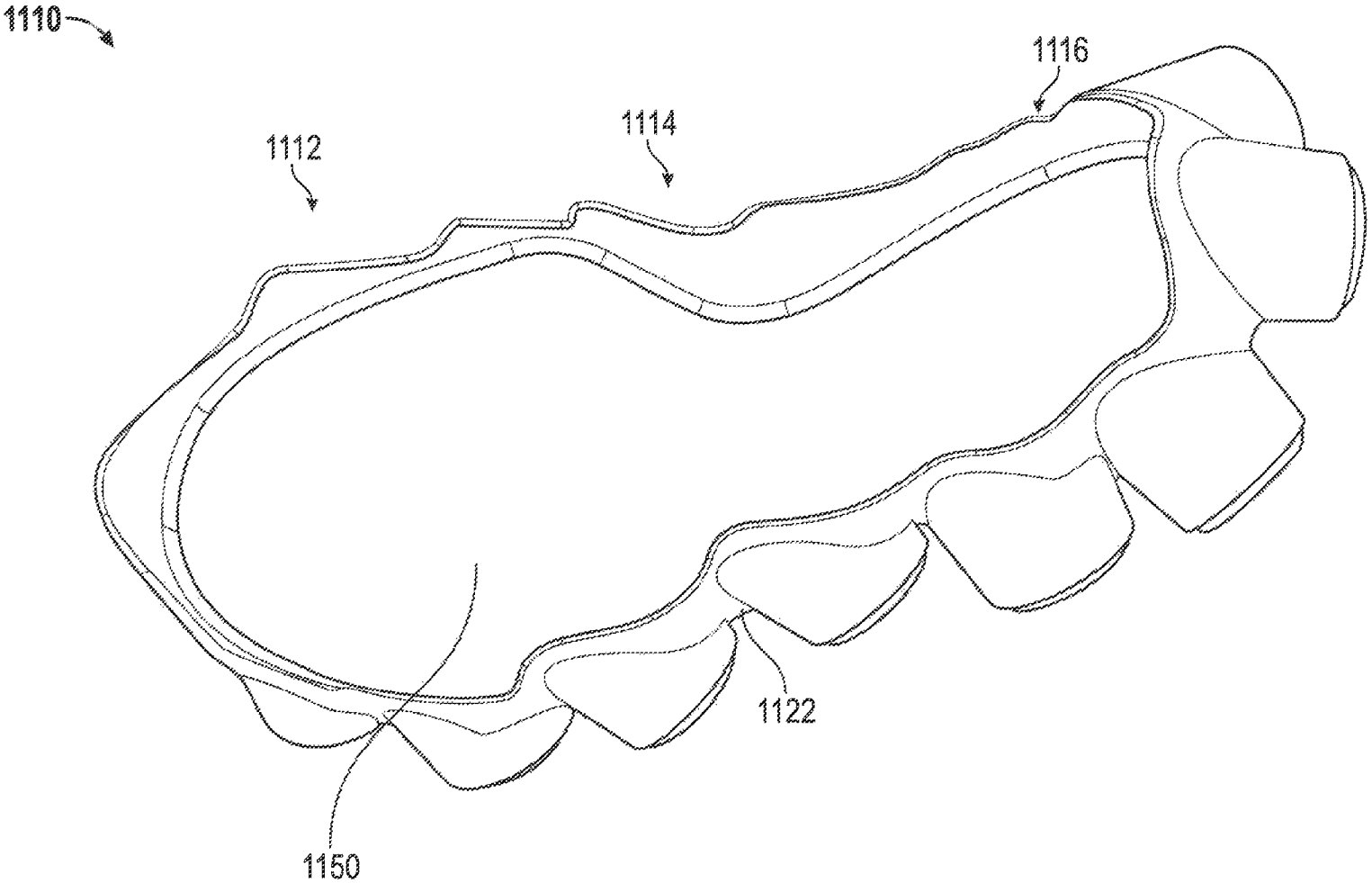
FIG. 13 is a top perspective view of an exemplary sole according to an embodiment of the present invention.
Figure 14:
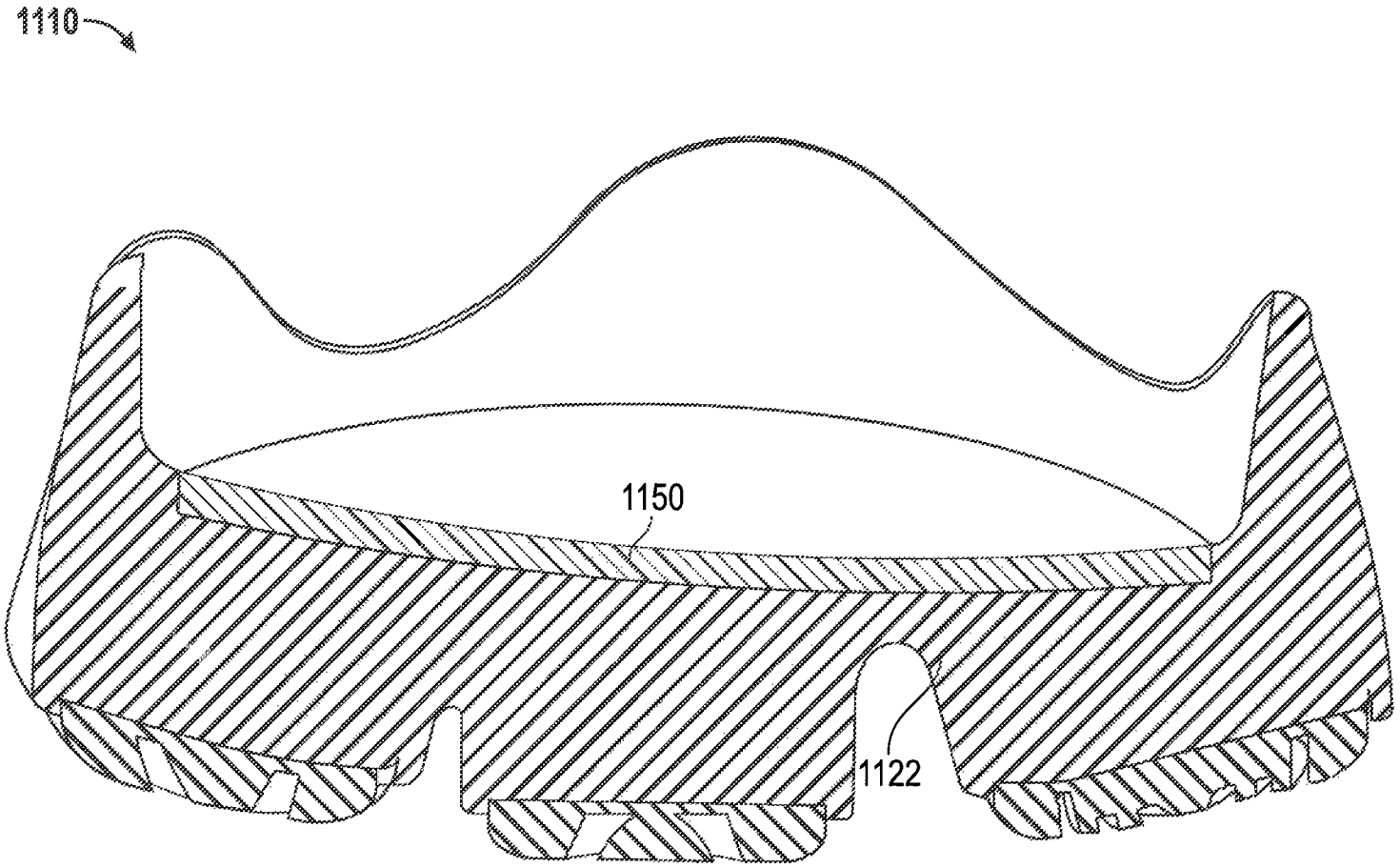
FIG. 14 is a front sectional view of the exemplary sole of FIG. 13 according to an embodiment of the present invention.

Plate 1150, as shown in FIGS. 13 and 14, may be disposed to correspond to a forefoot portion 1112, midfoot portion 1114, and heel portion 1116 of sole 1110 and in some embodiments may be monolithic throughout its form. Plate 1150 may be disposed above a main body 1122 of plate 1150, as shown in the cross-sectional view of FIG. 14. Plate 1150 need not be so disposed however, and may be disposed, for example, below main body 1122, or above an insole of sole 1110. Plate 950, of FIG. 10, may be configured similarly to plate 1150.

Figure 15:
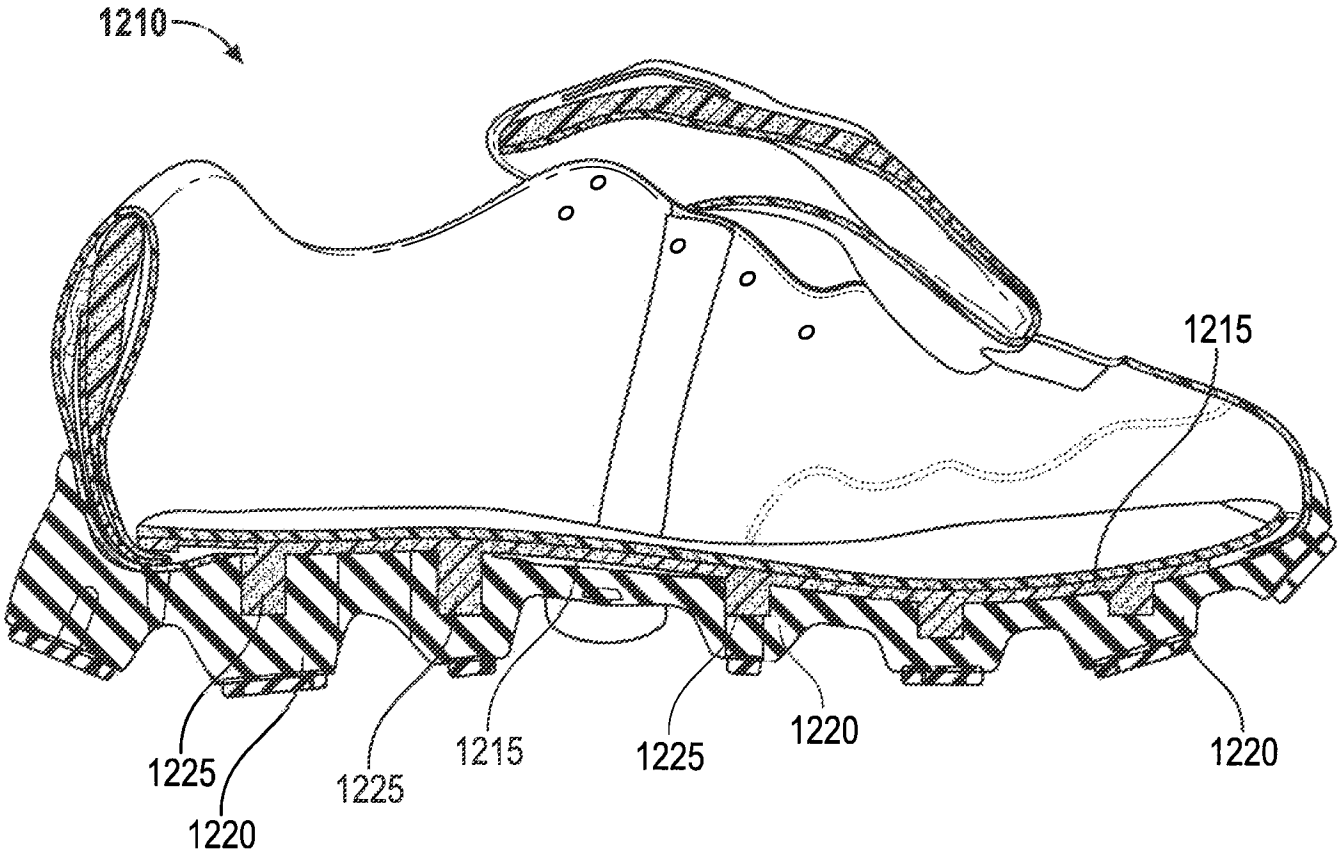
FIG. 15 is a side sectional view of an exemplary article of footwear according to an embodiment of the present invention.

In some embodiments, as shown, for example, in FIG. 15, in which like reference numerals refer to like elements, a sole 1210 may have projections 1220, where one or more projections 1220 includes a support pillar 1225 therein. Pillars 1225 may be formed of a material having greater or lesser rigidity than the material forming projections 1220. Where pillars 1225 have greater rigidity than projections 1220, pillars 1225 may impart increased rigidity to projections 1220, thereby increasing the support of sole 1210 and limiting splay of projections 1220. Where pillars 1225 have lesser rigidity than projections 1220, pillars 1225 may impart reduced rigidity to projections 1220, thereby decreasing the support of sole 1210 and promoting splay of projections 1220, which may promote traction of sole 1210. In some embodiments, pillars 1225 are separately formed within projections 1220. In some embodiments, pillars 1225 are formed as extensions from a support plate (e.g., plate 1215, as shown in FIG. 15).

Figure 16:
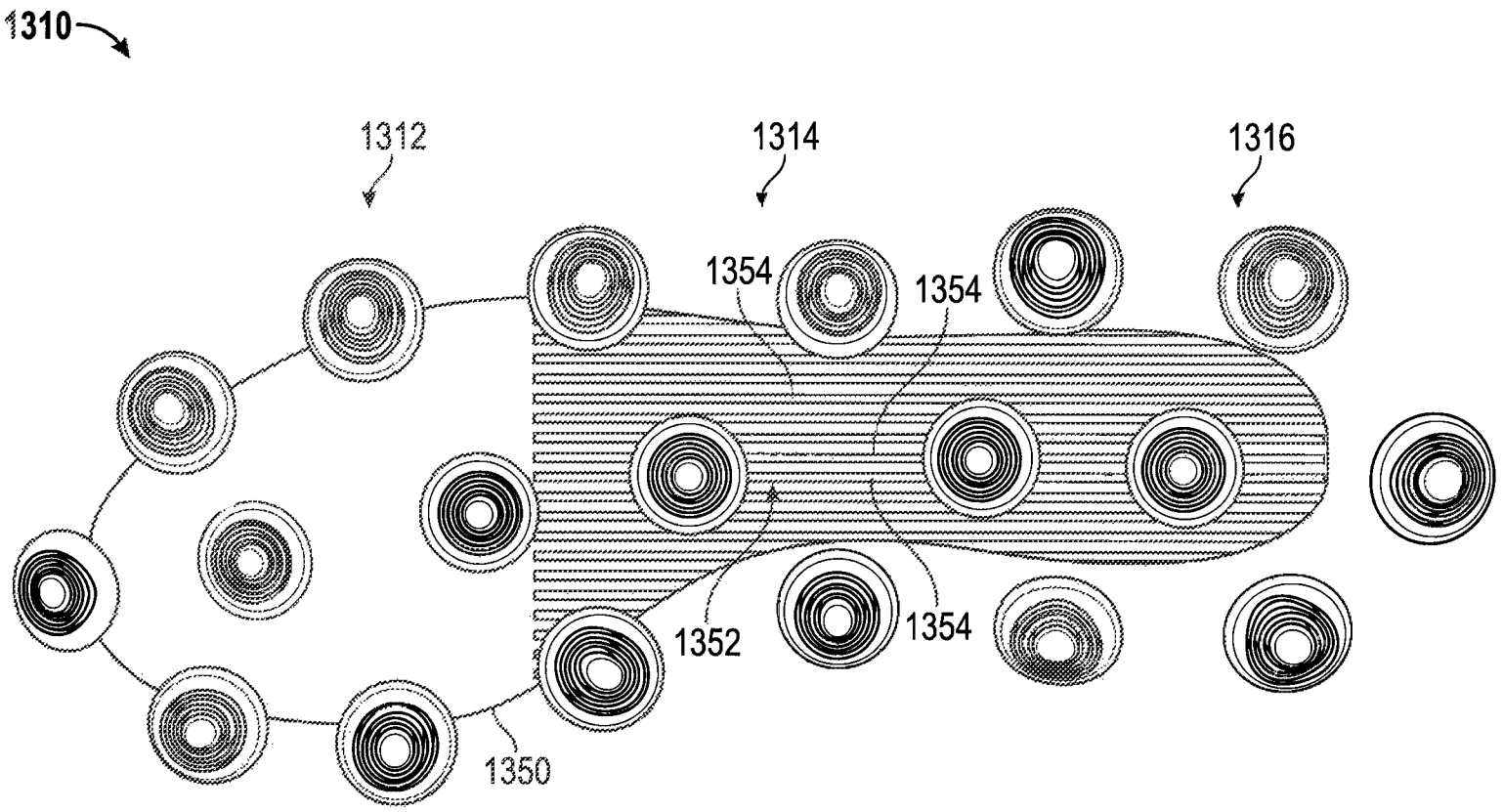
FIG. 16 is a bottom view of portions of an exemplary sole according to an embodiment of the present invention.
Figure 17:
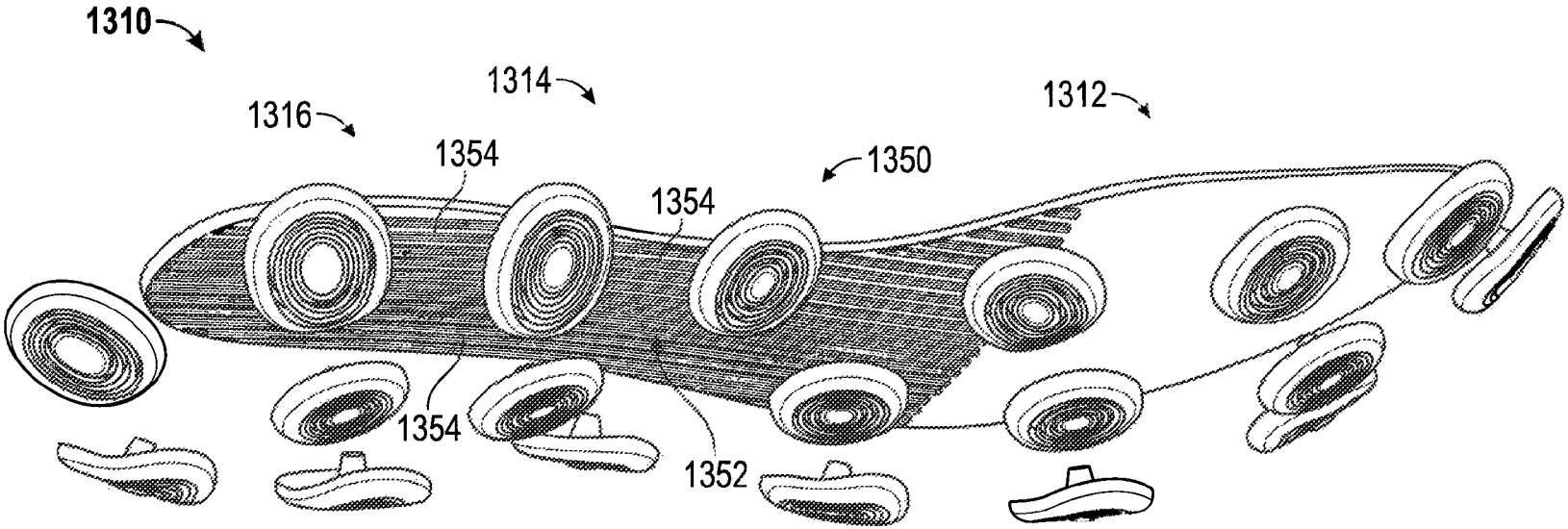
FIG. 17 is a bottom medial side perspective view of the portions of the exemplary sole of FIG. 16 according to an embodiment of the present invention.

In some embodiments, as shown, for example, in FIGS. 16 and 17, a sole 1310 (shown without a main body or projections, to facilitate depiction) may include a structural plate 1350 having rigidity features 1352 on a top surface thereof, bottom surface thereof, or both. For example, plate 1350 may include longitudinal ribs 1354, to impart rigidity in a longitudinal direction along their length. Such ribs may be oriented, sized, and positioned as desired to achieve desired rigidity of the plate in which they are incorporated. For example, ribs 1354 are disposed in a heel portion 1316 and midfoot portion 1314 of plate 1350, thereby resulting in greater longitudinal rigidity in the heel portion 1316 and midfoot portion 1314 of plate 1350 than in a forefoot portion 1312 of plate 1350. In some embodiments, for example, rigidity features 1352 may be fibers of a fiber-reinforced polymer, including, for example, woven or uni-directional carbon fiber, which may be applied to or incorporated within plate 1350.

Various exemplary arrangements of projections have been described herein with reference to exemplary embodiments. It should be understood that the locations and sizes (e.g., heights, geometric shapes/dimensions/ratios) of the projections and other elements described herein (e.g., bridge elements, structural plates) can be altered as desired for any reason, and that such alteration is within the scope of the present invention. For example, such alteration may be effected to accommodate forces expected to be encountered during a particular activity, to provide therapeutic support to a wearer with a particular injury or condition, or to achieve a particular aesthetic appearance.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

a foam sole comprising a main sole body extending continuously into a plurality of foam projections, the foam sole having a medial side, a lateral side, and a longitudinal axis, wherein the plurality of foam projections includes a central row of projections extending along the longitudinal axis of the foam sole, a lateral row of projections on the lateral side of the foam sole, and a medial row of projections on the medial side of the foam sole;

wherein every projection in the central row of projections is disposed on the longitudinal axis, wherein every projection in the lateral row of projections is disposed on a lateral edge of the lateral side of the foam sole, wherein every projection in the medial row of projections is disposed on a medial edge of the medial side of the foam sole, wherein projections of the central row are disposed next to projections of the lateral row with no projections therebetween, wherein projections of the central row are disposed next to projections of the medial row with no projections therebetween, wherein, in a heel portion of the foam sole, at least one of the projections in the central row of projections extends further from a bottom surface of the main sole body in a vertical direction than a most-proximate projection in the lateral row of projections or the medial row of projections, wherein, in the heel portion of the foam sole, at least one of the projections in the lateral row of projections extends further from the bottom surface of the main sole body in a vertical direction than an adjacent projection in the lateral row of projections, the adjacent projection disposed closer to a midfoot portion of the foam sole than the at least one of the projections in the lateral row of projections, wherein, in a forefoot portion of the foam sole, the foam sole further comprises a hub-and-spoke arrangement extending continuously from the main sole body, the hub-and-spoke arrangement comprising a plurality of bridge elements monolithic with the main sole body and extending radially outward from a central hub foam projection of the central row of projections, wherein the plurality of bridge elements connect only to adjacent foam projections in the central row of projections, the lateral row of projections, and the medial row of projections, wherein the central hub connects to a first adjacent foam projection in the central row of projections longitudinally forward of the central hub, a second adjacent foam projection in the central row of projections longitudinally rearward of the central hub, a third adjacent foam projection in the lateral row of projections lateral to the central hub, and a fourth adjacent foam projection in the medial row of projections medial to the central hub, and wherein every projection is configured to contact a surface separately when a user is moving under the user's own power.

2. The article of footwear of claim 1, wherein the central row of projections includes a rear heel projection having a central axis that extends at a non-orthogonal angle from the rear of the main sole body.

3. The article of footwear of claim 1, wherein an outsole material is provided on a lower surface of one or more of the projections, the outsole material being a different material from material forming the projections.

4. The article of footwear of claim 1, wherein the bridge element is formed by an overlap in adjacent projections.

5. The article of footwear of claim 1, wherein projections in the lateral row of projections have central axes that extend from the main sole body at a non-orthogonal angle.

6. The article of footwear of claim 1, wherein projections in the medial row of projections have central axes that extend from the main sole body at a non-orthogonal angle.

7. The article of footwear of claim 1, wherein every projection in the central row of projections extends further from the main sole body in a vertical direction than an adjacent projection in the lateral row of projections or the medial row of projections.

8. The article of footwear of claim 1, wherein the foam sole further comprises a plate disposed above the main sole body, wherein the plate comprises a plurality of pillars extending therefrom, and wherein each pillar extends within a projection of the plurality of foam projections.

9. An article of footwear comprising:

a foam sole comprising a main sole body and a plurality of foam projections extending from a bottom surface of the main sole body, the foam sole having a medial side, a lateral side, and a longitudinal axis, wherein the foam sole includes a forefoot portion, a midfoot portion, and a heel portion, wherein the plurality of foam projections includes a central row of projections extending along the longitudinal axis of the foam sole, a lateral-most row of projections on the lateral side of the foam sole, and a medial-most row of projections on the medial side of the foam sole;

wherein the lateral-most row of projections comprises lateral-most projections having an edge disposed at a lateral edge of the lateral side of the foam sole, wherein the medial-most row of projections comprises medial-most projections having an edge disposed at a medial edge of the medial side of the foam sole, wherein, in the heel portion of the foam sole, at least one of the lateral-most projections in the lateral-most row of projections extends further from the bottom surface of the main sole body in a vertical direction than at least one of the medial-most projections in the medial-most row of projections, wherein the at least one lateral-most projection and the at least one medial-most projection are disposed directly laterally opposite each other across the longitudinal axis, wherein, in the forefoot portion of the foam sole, the foam sole further comprises a hub-and-spoke arrangement extending continuously from the main sole body, the hub-and-spoke arrangement comprising a plurality of bridge elements monolithic with the main sole body and extending radially outward from a central hub foam projection of the central row of projections, wherein the plurality of bridge elements connect only to adjacent foam projections in the central row of projections, the lateral-most row of projections, and the medial-most row of projections, wherein the central hub connects to a first adjacent foam projection in the central row of projections longitudinally forward of the central hub, a second adjacent foam projection in the central row of projections longitudinally rearward of the central hub, a third adjacent foam projection in the lateral-most row of projections lateral to the central hub, and a fourth adjacent foam projection in the medial-most row of projections medial to the central hub, and wherein every projection is configured to contact a surface separately when a user is moving under the user's power.

10. The article of footwear of claim 9, wherein the central row of projections includes a rear heel projection extending at an angle from the rear of the main sole body.

11. The article of footwear of claim 9, wherein an outsole material is provided on a lower surface of one or more of the projections.

12. The article of footwear of claim 9, wherein the central hub provides additional stability to the article of footwear.

13. The article of footwear of claim 9, wherein projections in the lateral-most row of projections extend from the main sole body at an angle.

14. The article of footwear of claim 9, wherein projections in the medial-most row of projections extend from the main sole body at an angle.

15. The article of footwear of claim 9, wherein the projections include at least one cylindrical projection.

16. The article of footwear of claim 9, wherein the projections include at least one rectangular projection.

17. The article of footwear of claim 9, wherein the projections include at least one semi-spherical projection.

18. An article of footwear comprising:

a main sole body comprising foam;

a plurality of foam projections extending downward from a bottom surface of the main sole body, wherein the plurality of foam projections includes a central row of projections, a lateral-most row of projections, and a medial-most row of projections; and a hub-and-spoke arrangement, in a forefoot portion of the main sole body, extending continuously from the main sole body, the hub-and-spoke arrangement comprising a plurality of bridge elements monolithic with the main sole body and extending radially outward from a central hub foam projection of the central row of projections, wherein the plurality of bridge elements connect only to adjacent foam projections in the central row of projections, the lateral-most row of projections, and the medial-most row of projections, wherein every projection in the central row of projections is disposed on the longitudinal axis, wherein every projection in the lateral-most row of projections is disposed on a lateral edge of the main sole body, wherein every projection in the medial-most row of projections is disposed on a medial edge of the main sole body, wherein the article of footwear includes no projections between the central row of projections and the medial-most row of projections, wherein the article of footwear includes no projections between the central row of projections and the lateral-most row of projections, wherein, in the heel portion of the foam sole, each projection in the lateral-most row of projections extends further from the bottom surface of the main sole body in a vertical direction than a projection at a corresponding point along a longitudinal length of the main sole body in the medial-most row of projections, wherein the central hub connects to a first adjacent foam projection in the central row of projections longitudinally forward of the central hub, a second adjacent foam projection in the central row of projections longitudinally rearward of the central hub, a third adjacent foam projection in the lateral-most row of projections lateral to the central hub, and a fourth adjacent foam projection in the medial-most row of projections medial to the central hub, and wherein every projection is configured to contact a surface separately when a user is moving under the user's own power.

19. The article of footwear of claim 1, wherein the plurality of projections are monolithic with the main sole body.

20. The article of footwear of claim 1, wherein the plurality of foam projections consists of nineteen foam projections.

21. The article of footwear of claim 9, wherein the plurality of foam projections consists of nineteen foam projections.

22. The article of footwear of claim 18, wherein the plurality of foam projections consists of nineteen foam projections.

* * * * *